US010418761B2

(12) United States Patent
Garcia et al.

(10) Patent No.: US 10,418,761 B2
(45) Date of Patent: Sep. 17, 2019

(54) HYBRID COAXIAL CABLE FABRICATION

(71) Applicant: Keysight Technologies, Inc., Santa Rosa, CA (US)

(72) Inventors: Dan Garcia, Colorado Springs, CO (US); Lewis R. Dove, Monument, CO (US); Peter J. Martinez, Colorado Springs, CO (US); Doug Baney, Santa Clara, CA (US)

(73) Assignee: Keysight Technologies, Inc., Santa Rosa, CA (US)

( * ) Notice: Subject to any disclaimer, the term of this patent is extended or adjusted under 35 U.S.C. 154(b) by 0 days.

(21) Appl. No.: 15/851,685

(22) Filed: Dec. 21, 2017

(65) Prior Publication Data

US 2019/0109419 A1 Apr. 11, 2019

Related U.S. Application Data

(63) Continuation-in-part of application No. PCT/US2017/055712, filed on Oct. 9, 2017.

(51) Int. Cl.
*H01R 13/648* (2006.01)
*H01R 24/40* (2011.01)
(Continued)

(52) U.S. Cl.
CPC ..... *H01R 24/40* (2013.01); *H01B 7/0054* (2013.01); *H01P 3/06* (2013.01); *H01R 13/405* (2013.01); *H01R 43/20* (2013.01)

(58) Field of Classification Search
CPC ..... H01R 13/405; H01R 24/40; H01R 43/20; H01B 7/0054; H01P 3/06
(Continued)

(56) References Cited

U.S. PATENT DOCUMENTS 2,552,707 A * 5/1951 Bird ..... H01R 24/44 174/21 C
2,556,642 A * 6/1951 Bird ..... H01P 1/262 174/15.1
(Continued)

FOREIGN PATENT DOCUMENTS

CN 201243152 Y 5/2009
EP 675507 B1 6/2000
(Continued)

OTHER PUBLICATIONS

Co-pending U.S. Appl. No. 15/820,988, filed Nov. 22, 2017.
(Continued)

*Primary Examiner* — Abdullah A Riyami
*Assistant Examiner* — Vladimir Imas

(57) ABSTRACT

A signal transmission line, includes: a coaxial electrical connector comprising a coaxial electrical connector inner conductor and a coaxial outer conductor; a coaxial cable comprising a coaxial inner conductor and a coaxial outer conductor; and a section of resistive cable disposed between the coaxial cable and the coaxial connector, the section of resistive cable comprising an electrically thin resistive layer disposed between the coaxial cable inner conductor and a section outer conductor. The coaxial cable inner conductor is fastened to the coaxial electrical connector inner conductor.

21 Claims, 26 Drawing Sheets

(51) Int. Cl.

| | |
|---|---|
| ***H01R 13/405*** | (2006.01) |
| ***H01B 7/00*** | (2006.01) |
| ***H01P 3/06*** | (2006.01) |
| ***H01R 43/20*** | (2006.01) |

(58) Field of Classification Search
USPC ..... 439/607.02, 578
See application file for complete search history.

(56) References Cited

U.S. PATENT DOCUMENTS 3,158,823 A * 11/1964 Bird ..... H01P 1/262 174/15.1
3,460,072 A * 8/1969 Ziegler, Jr. ..... H01P 5/026 333/33
3,544,928 A * 12/1970 Keiter ..... H01B 11/1834 333/245
3,671,662 A 6/1972 Miller et al.
3,733,692 A * 5/1973 Fietz ..... H01F 6/06 174/125.1
4,004,257 A * 1/1977 Geissler ..... H01P 1/15 333/207
4,035,054 A * 7/1977 Lattanzi ..... H01R 24/44 439/578
4,108,736 A * 8/1978 Rigo ..... C25D 11/02 205/188
4,145,565 A 3/1979 Donon
4,168,343 A * 9/1979 Arai ..... H01L 49/02 252/512
4,469,539 A * 9/1984 Wade ..... H01B 1/24 156/298
4,510,468 A 4/1985 Mayer
4,641,120 A * 2/1987 Bonfig ..... H01H 85/32 337/242
4,669,805 A * 6/1987 Kosugi ..... H01R 24/52 333/21 R
4,734,046 A * 3/1988 McAllister ..... G01R 1/073 439/101
4,794,331 A * 12/1988 Schweitzer, Jr. ..... G01R 19/14 324/133
4,853,656 A * 8/1989 Guillou ..... H01P 5/026 333/260
4,952,174 A * 8/1990 Sucht ..... H01R 9/05 439/584
4,964,805 A * 10/1990 Gabany ..... H01R 24/50 439/434
5,011,432 A * 4/1991 Sucht ..... H01R 9/05 439/584
5,029,243 A 7/1991 Dammann et al.
5,065,123 A 11/1991 Heckaman et al.
5,468,913 A 11/1995 Seaman et al.
5,696,474 A * 12/1997 Spivey ..... H01P 1/04 333/245
5,817,981 A 10/1998 Arroyo
5,894,197 A 4/1999 Langlois
6,023,209 A 2/2000 Faulkner et al.
6,234,838 B1 * 5/2001 Wong ..... H01R 9/0524 439/394
6,259,496 B1 7/2001 Kashima
6,417,454 B1 7/2002 Biebuyck
6,447,333 B1 * 9/2002 Springer ..... H01R 9/05 439/578
6,666,725 B2 * 12/2003 Botka ..... H01R 24/40 439/675
6,816,039 B1 * 11/2004 Taylor ..... H01P 3/06 333/243
7,375,414 B2 * 5/2008 Forbes ..... G11C 5/063 257/662
7,811,125 B2 * 10/2010 Kretz ..... H01R 24/40 439/578
7,829,979 B2 * 11/2010 Forbes ..... G11C 5/063 257/659
7,896,020 B2 3/2011 D'Antona et al.
7,986,020 B2 7/2011 Kagaya
8,063,713 B2 11/2011 Cheng et al.
8,134,424 B2 * 3/2012 Kato ..... H01R 24/44 333/24 C
8,212,580 B2 7/2012 Izadian
8,257,112 B2 * 9/2012 Tilley ..... H01R 4/70 439/586
8,388,375 B2 3/2013 Chawgo et al.
8,508,311 B2 8/2013 Wu et al.
8,657,066 B2 2/2014 Doneker et al.
8,658,897 B2 2/2014 Doneker et al.
8,943,686 B2 * 2/2015 Hartford ..... H01R 13/53 148/22
9,117,649 B2 * 8/2015 Csibi ..... H01J 61/35
9,362,601 B2 6/2016 McKinzie, III
9,496,606 B2 * 11/2016 Iso ..... H01P 3/085
9,574,661 B2 2/2017 Somoza et al.
9,847,566 B2 * 12/2017 Henry ..... H01P 1/222
9,900,032 B1 2/2018 Vook
9,983,376 B2 * 5/2018 Charbonneau-Lefort ..... G02B 6/4416
10,109,904 B2 10/2018 Lee et al.
2002/0180923 A1 12/2002 Aoyagi et al.
2003/0070842 A1 4/2003 Bailey et al.
2003/0151476 A1 8/2003 Salmela et al.
2005/0067159 A1 * 3/2005 Hall ..... E21B 17/003 166/65.1
2005/0259195 A1 11/2005 Koganeza
2007/0014946 A1 1/2007 Huang et al.
2007/0209823 A1 9/2007 Vexler et al.
2009/0111315 A1 * 4/2009 Kato ..... H01R 24/44 439/368
2010/0000982 A1 1/2010 Allgaier et al.
2010/0085132 A1 4/2010 Cheng et al.
2010/0171042 A1 7/2010 Kellerman et al.
2010/0277256 A1 11/2010 Concord
2012/0025925 A1 2/2012 Wu et al.
2012/0112784 A1 5/2012 Masuda et al.
2012/0194291 A1 8/2012 Pajovic et al.
2012/0239209 A1 9/2012 Brown et al.
2012/0299669 A1 * 11/2012 Ryu ..... H01P 1/264 333/22 R
2013/0112477 A1 5/2013 Lorenz et al.
2014/0170919 A1 * 6/2014 Manipatruni ..... D01D 5/00 442/188
2014/0227905 A1 * 8/2014 Knott ..... H01R 24/44 439/578
2015/0004833 A1 * 1/2015 Ryu ..... H01R 13/53 439/578
2017/0025149 A1 1/2017 Ahner et al.
2017/0047632 A1 2/2017 Lee et al.
2017/0047633 A1 2/2017 Lee et al.
2017/0250453 A1 8/2017 Lee et al.
2018/0108966 A1 4/2018 Lee et al.

FOREIGN PATENT DOCUMENTS

JP H05264620 A 10/1993
KR 20140064044 A 5/2014
KR 20160033132 A 3/2016
KR 20170053695 A 5/2017
KR 20170105246 A 9/2017
WO 2017027109 2/2017

OTHER PUBLICATIONS

International Application No. PCT/US2017/067210 filed Dec. 19, 2017.
Final Office Action date Mar. 16, 2018 in co-pending U.S. Appl. No. 15/594,996, 29 pages.
Office Action dated Jan. 25, 2018 in co-pending U.S. Appl. No. 14/823,997, 13 pages [Office Action only].
Chakraborty et al., Exploiting the loss-frequency relationship using RF communication in Underwater communication networks,Dec. 14-16, 2009, 4th International Conference on Computers and Devices for Communication, pp. 1-4.

(56) References Cited

OTHER PUBLICATIONS

Garg et al., A Thin Wall Leaky Waveguide Antenna, Jan. 1975, IEEE Transactions on Antennas and Propagation, pp. 107-112.
Co-pending U.S. Appl. No. 15/223,901, filed Jul. 29, 2016.
Notice of Allowance dated Jun. 30, 2017 in co-pending U.S. Appl. No. 15/223,901, 9 pages.
Supplemental Notice of Allowability dated Nov. 20, 2017 in co-pending U.S. Appl. No. 15/233,901, 5 pages.
International Patent Application No. PCT/US17/55712 filed Oct. 9, 2017.
Ferran Martin, "Chapter: Other Advanced Transmission Lines," Artificial Transmission Lines for RF and Microwave Applications, 2015, pp. 410-414.
"Differential signaling," downloaded from en.wikipedia.org/wiki/Differential_signaling no later than Sep. 28, 2017, pp. 1-5.
"Single-Ended vs. Differential Inputs," downloaded from omega.com/techref/das/se-differential.html no later than Sep. 28, 2017, pp. 1-2.
Notice of Allowance dated Nov. 3, 2017 in co-pending U.S. Appl. No. 15/223,901, 13 pages.
Office Action dated Nov. 2, 2017 in co-pending U.S. Appl. No. 15/594,996, 16 pages.
Deng, et al., "An Experimental Investigation of Higher Order Mode Suppression in TEM Cells," IEEE Transactions on Electromagnetic Compatibility, vol. 50, No. 2, May 2008, pp. 416-419.
International Search Report & Written Opinion dated Oct. 19, 2016 for International Application No. PCT/US2012/039593, 12 pages.
Howard, et al., "Improvising VSWR and Bandwidth by Eliminating Steps in Coaxial Connectors," International Conference on Computing, Engineering, and Information, Fullerton, California, USA, Apr. 2-4, 2009, pp. 237-239.
Oldfield, et al., "The Importance of Coax Connector Design Above 110 GHz," Anritsu Technical Review No. 22, Sep. 2014, pp. 40-44.
English language machine translation of CN201243152Y, published May 20, 2009, 7 pages.
Notice of Allowance dated Aug. 24, 2017 for U.S. Appl. No. 14/823,997.
Notice of Allowance dated May 31, 2017 in co-pending U.S. Appl. No. 14/823,997, 9 pages.
Office Action dated Feb. 9, 2017 in co-pending U.S. Appl. No. 14/823,997.
Maistrenko, et al., "Experimental Investigation of Shielded Microstriplines with Resistive Films in Substrate", 2005 15th Int. Crimean Conference "Microwave & Telecommunication Technology", Sep. 12-16, Sevastopol, Crimea, Ukraine.
Maistrenko, et al., "Calculation of Shielded Microstrip Line with Various Configuration of Resistance Films in Substrate", 2004 14th Int. Crimean Conference "Microwave & Telecommunication Technology", Sep. 13-17, Sevastopol, Crimea, Ukraine.
International Search Report dated Jul. 17, 2018, 12 pgs.
International Search Report & Written Opinion dated Oct. 19, 2016 for International Application No. PCT/US2016/039593, 12 pages.
European Search Report dated Feb. 25, 2019, 19 pgs.
Mihai Badic et al., "Electromagnetic Characterization of Conductive Magnetic/Non-Magnetic Shielding Materials," Electromagnetic Compatibility, vol. 1, EMC 2005. International Symposium on Chicago, IL, USA, Year: 2005, vol. 1, pp. 185-189.
Myron L. Crawford et al., "Expanding the Bandwidth of TEM Cells for EMC Measurements," IEEE Transactions on Electromagnetic Compatibility, Aug. 1, 1978, vol. EMC-20, No. 3, pp. 368-374.
J. G. Davis et al., "Higher Order Mode Impedances and Cut-Off Frequencies of Overmoded Coaxial Waveguides," International journal of Electronics, May 1, 2006, vol. 93, No. 5, pp. 335-346.
Non-Final Office Action dated Feb. 5, 2019 for U.S. Appl. No. 15/820,988, 30 pages.
Non-Final Office Action dated Aug. 11, 2017 for U.S. Appl. No. 15/008,368, 32 pages.
Examiner's Interview Summary dated Dec. 22, 2017 for U.S. Appl. No. 15/008,368, 3 pages.
Final Office Action dated Jan. 25, 2018 for U.S. Appl. No. 15/008,368, 37 pages.
Examiner's Interview Summary dated Mar. 16, 2018 for U.S. Appl. No. 15/594,996, 2 pages.
Notice of Allowance dated Aug. 9, 2018 for U.S. Appl. No. 14/823,997, 18 pages.
Rule 111 Response dated Dec. 11, 2017 for U.S. Appl. No. 15/008,368, 17 pages.
International Search Report and Written Opinion dated Sep. 19, 2018 for Application No. PCT/US2017/067210, 13 pgs.
"Understanding Common Mode Noise", Pulse Electronics, 4/99, downloaded from http://www.pulseelectronics.com/download/3100/g019/pdf, pp. 1-7.
S. Ramo et al. "Fields and Waves in Communications Electronics", 2nd edition, 1984, John Wiley and Sons, p. 252.
"EMPRO, 3D Electromagnetic Modeling and Simulation Environment Integrated with your ADS Design Flow," Keysight EEsof EDA, Sep. 26, 2017, http://literature.cdn.keysight.com/litweb/pdf/5990-4819EN.pdf?id=1793182-1-eng, pp. 1-10.
Chinese Office Action dated Mar. 21, 2019, 9 pgs.
Machine translation of Chinese Office Action dated Mar. 21, 2019, 8 pgs.

* cited by examiner

HYBRID COAXIAL CABLE FABRICATION

CROSS REFERENCE TO RELATED APPLICATIONS

This application is a continuation-in-part under 37 C.F.R. § 1.53(b) of commonly owned International Application No. PCT/US17/55712 to Garcia, et al. entitled "Hybrid Coaxial Cable Fabrication" filed on Oct. 9, 2017. The present application claims priority under 35 U.S.C. § 120 to International Application No. PCT/US17/55712, the disclosure of which is hereby incorporated by reference in its entirety.

BACKGROUND

Signal transmission lines ('transmission lines') are ubiquitous in modern communications. These transmission lines transmit electromagnetic (EM) signals ('signals') from point to point, and take on various known forms including coaxial ("coax") cables. For many years, coaxial cables included three primary elements, a center conductor, an outer conductor around the center conductor, and a dielectric between the center conductor and the outer conductor. However, a single eigenmode ('single mode') of signal propagation is desirable for coaxial cables insofar as multi-mode signal propagation is problematic because the desired propagation mode and higher-order modes can interfere with each other, and result in an uncontrolled and un-interpretable received signal. In high-bandwidth, high-quality signal environments multi-mode signal propagation is typically unacceptable.

Recently, a transmission line that fosters discrimination of a desired mode of signal propagation from the higher-order modes has been proposed. In the proposed transmission line, a resistive sheet is to be placed within the dielectric layer. However, requirements for characteristics and placement of the resistive sheet are specific, so the proposed transmission line cannot be obtained simply by placing any resistive sheet in any matter within a dielectric layer about, for example, the common axis of a coaxial cable.

The recent development of transmission lines with resistive sheets has encountered concerns in terms of fabrication, since traditional semi-rigid cable fabrication methods have a limited range of operation due to the cutoff frequency. For example, traditional semi-rigid cables are processed with a single dielectric layer and do not allow a hybrid multilayered construction. Significant capital expenses and manufacturing space are needed to manufacture semi-rigid cables due to large reel to reel minimum lot runs. Additionally, conventional semi-rigid cable processing and preparation methods can be crude insofar as known cut-off frequencies can tolerate such crude methods, whereas in a mode-less configuration these methods are not suitable. Moreover, conventional helically-wrapped flex cables do not utilize a centered resistive layer to increase frequency performance

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

Figure 1A:
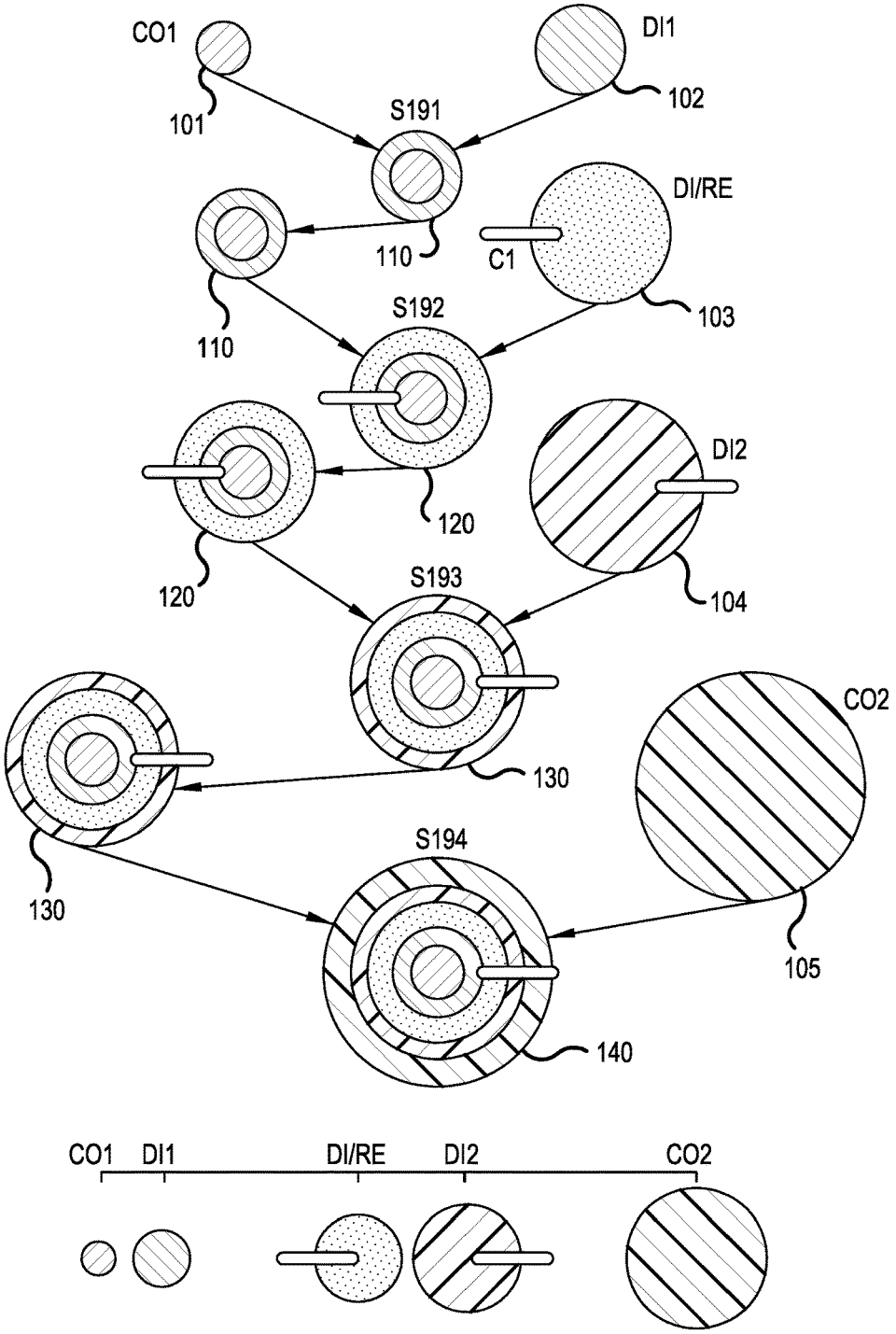
FIG. 1A illustrates hybrid coaxial cable components and an arrangement for manufacturing the hybrid coaxial cable in accordance with a representative embodiment.

In the following detailed description, for purposes of explanation and not limitation, example embodiments disclosing specific details are set forth in order to provide a thorough understanding of an embodiment according to the present teachings. However, it will be apparent to one having ordinary skill in the art having the benefit of the present disclosure that other embodiments according to the present teachings that depart from the specific details disclosed herein remain within the scope of the appended claims. Moreover, descriptions of well-known apparatuses and methods may be omitted so as to not obscure the description of the example embodiments. Such methods and apparatuses are clearly within the scope of the present teachings.

The terminology used herein is for purposes of describing particular embodiments only, and is not intended to be limiting. The defined terms are in addition to the technical and scientific meanings of the defined terms as commonly understood and accepted in the technical field of the present teachings.

Unless otherwise noted, when a first element (e.g., a signal transmission line) is said to be connected to a second element (e.g., another signal transmission line), this encompasses cases where one or more intermediate elements (e.g., an electrical connector) may be employed to connect the two elements to each other. However, when a first element is said to be directly connected to a second element, this encompasses only cases where the two elements are connected to each other without any intermediate or intervening devices. Similarly, when a signal is said to be coupled to an element, this encompasses cases where one or more intermediate elements may be employed to couple the signal to the element. However, when a signal is said to be directly coupled to an element, this encompasses only cases where the signal is directly coupled to the element without any intermediate or intervening devices.

As used in the specification and appended claims, the terms 'a', 'an' and 'the' include both singular and plural referents, unless the context clearly dictates otherwise. Thus, for example, 'a device' includes one device and plural devices. As used in the specification and appended claims, and in addition to their ordinary meanings, the terms 'substantial' or 'substantially' mean to within acceptable limits or degree. As used in the specification and the appended claims and in addition to its ordinary meaning, the term 'approximately' means to within an acceptable limit or amount to one having ordinary skill in the art. For example, 'approximately the same' means that one of ordinary skill in the art would consider the items being compared to be the same.

Relative terms, such as "above," "below," "top," "bottom," may be used to describe the various elements' relationships to one another, as illustrated in the accompanying drawings. These relative terms are intended to encompass different orientations of the elements thereof in addition to the orientation depicted in the drawings. For example, if an apparatus (e.g., a semiconductor package) depicted in a drawing were inverted with respect to the view in the drawings, an element described as "above" another element, for example, would now be "below" that element. Similarly, if the apparatus were rotated by 90° with respect to the view in the drawings, an element described "above" or "below" another element would now be "adjacent" to the other element; where "adjacent" means either abutting the other element, or having one or more layers, materials, structures, etc., between the elements.

In accordance with a representative embodiment, a coaxial cable includes, in order, a center conductor, a first dielectric layer, a resistive layer, a second dielectric layer and an outer conductor. A method of manufacturing the coaxial cable includes placing a first dielectric layer around a center conductor along a center axis, placing a resistive layer around the first dielectric layer along the center axis, placing a second dielectric layer around the resistive layer along the center axis, and placing an outer conductor around the second dielectric layer along the center axis. The resistive layer is electrically thin, and is described herein sometimes as an electrically thin resistive layer. The electrically thin resistive layer is configured to be substantially transparent to a substantially transverse electric magnetic (TEM) mode of transmission, and yet to substantially completely attenuate higher order modes of transmission. The substantially TEM mode is generally to be considered the lowest order (and desired mode) of the coaxial cables described herein. To this end, a TEM mode is somewhat of an idealization that follows from the solutions to Maxwell's Equations. In reality, at any nonzero frequency, the "TEM mode" actually has small deviations from a purely transverse electric field due to the imperfect nature of the conductors of the transmission line. Also, inhomogeneity in the dielectric region(s) will lead to dispersion and deviation from the behavior of an 'ideal' TEM mode in coaxial cables at higher frequencies, whereas the TEM mode is supposed to be technically dispersionless. As such, the term "substantially TEM mode" accounts for such deviations from the ideal behavior due to the environment of the transmission lines of the representative embodiments described below. Electrically thin resistive layers are described in the following commonly assigned patent applications, the disclosures of which are hereby incorporated by reference in their entireties: U.S. patent application Ser. No. 15/820,988, filed Nov. 22, 2017, and entitled "Coaxial Transmission Line Including Electrically Thin Resistive Layer and Associated Method;" U.S. patent application Ser. No. 15/594,996, filed May 15, 2017, and entitled "Coaxial Transmission Line Including Electrically Thin Resistive Layer and Associated Method;" International Application No. PCT/US2016/039593, filed Jun. 26, 2016 and entitled "Electrical Connectors for Coaxial Transmission Lines Including Taper and Electrically Thin Resistive Layer"; U.S. patent application Ser. No. 15/008,368, filed Jan. 27, 2016 and entitled "Signal Transmission Line and Electrical Connector Including Electrically Thin Resistive Layer and Associated Methods", and U.S. patent application Ser. No. 14/823,997, filed Aug. 11, 2015 and entitled "Coaxial Transmission Line Including Electrically Thin Resistive Layer and Associated Methods".

The present teachings are described initially in connection with representative embodiments for manufacturing a coaxial cable as an example of a coaxial transmission line. As will be appreciated as the present description continues, the comparatively symmetrical structure of the coaxial cable enables the description of various salient features of the present teachings in a comparatively straight-forward manner. However, it is emphasized that the present teachings are not limited to representative embodiments comprising coaxial cables or even coaxial transmission lines generally. Rather, the present teachings are contemplated for use in other types of transmission lines to include transmission lines with an inner conductor that is geometrically offset relative to an outer conductor, stripline transmission lines, and microstrip transmission lines, which are transmitting substantially TEM modes. Moreover, the present teachings are contemplated for devices used to effect connections between a transmission line and an electrical device, or other transmission line (e.g., electrical connectors, adapters, attenuators, etc.). Such devices include coaxial electrical connectors that terminate the ends of a coaxial cables so as to maintain a coaxial form across the coaxial electrical connectors and have substantially the same impedance as the coaxial cables to reduce reflections back into the coaxial cables. Connectors are usually plated with high-conductivity metals such as silver or tarnish-resistant gold.

FIG. 1A illustrates hybrid coaxial cable components and an arrangement for manufacturing the hybrid coaxial cable in accordance with a representative embodiment. In FIG. 1A and many other FIGs. of the present disclosure, a pattern key is provided at the bottom to ensure easy reference for different components of the hybrid coaxial cables manufactured in the different embodiments described herein.

In FIG. 1A, components of a hybrid coaxial cable under construction include center conductor 101, first dielectric layer 102, a combined dielectric/resistive layer 103, a second dielectric layer 104, and an outer conductor 105. In FIG. 1A, additional labels are applied to the components, as these additional labels will be used consistently throughout this disclosure. The center conductor 101 is also labeled CO1. The first dielectric layer 102 is also labeled DI1. The combined dielectric/resistive layer 103 is also labeled DI/RE. The second dielectric layer is also labeled DI2. The outer conductor 105 is also labeled CO2.

In FIG. 1A, the first dielectric layer 102 is placed around the center conductor 101 to produce a first sub-assembly 110 at S191. The combined dielectric/resistive layer 103 is placed around the first sub-assembly 110 to produce a second sub-assembly 120 at S192. The second dielectric layer 104 is placed around the second sub-assembly 120 to produce a third sub-assembly 130 at S193. The outer conductor 105 is placed around the third sub-assembly 130 to produce a hybrid coaxial cable 140 at S194.

As an example of the processes in FIG. 1A, the first dielectric layer 102 may be extruded or slip fit over the center conductor 101. Extrusion is generally used to create objects with a fixed cross-sectional profile, and can be performed by pushing the center conductor 101 through dielectric material and then through a die of the desired cross-section with the dielectric material layered thereon. The result is first sub-assembly 110 with the center conductor 101 and the first dielectric layer 102 disposed therein. Slip fitting can be performed by drawing the center conductor 101 through an existing first dielectric layer 102 until ends are aligned.

Next, the combined dielectric/resistive layer 103 can be cut to a precise and predetermined width strip or predetermined width strips, and then wrapped around the first sub-assembly 110. The combined dielectric/resistive layer 103 uses a dielectric as a substrate for a resistive layer, and is detailed in the description for FIG. 8 herein. When the combined dielectric/resistive layer 103 is wrapped around the first sub-assembly 110, the combined dielectric/resistive layer 103 may initially have the appearance of the letter "C" in that a small gap (e.g., of less than 5% of the width) may be left initially. The small gap is shown by the line segment on the left side of the combined dielectric/resistive layer DI/RE in FIG. 1A. The result of wrapping the combined dielectric/resistive layer 103 is the second sub-assembly 120. Additionally, the "C" shape may be considered semi-circular such that the combined dielectric/resistive layer 103 has a semi-circular cross-section (shape), though the gap is ultimately removed or substantially removed such that, in the final product, the combined dielectric/resistive layer 103 may be circular and have a circular cross-section (circular shape).

In some or all embodiments described herein, the combined dielectric/resistive layer 103 (or parallel or analogous layers) are stretched, shrunken, tightened, or otherwise processed in a manner that reduces or eliminates burrs in the final product. This may generally be described as reducing the volume, cross-sectional diameter, area, length, or other characteristics of the combined dielectric/resistive layer 103 from when first placed compared to the final product. That is, an initial cross-sectional profile of the combined dielectric/resistive layer 103 (or parallel or analogous layers) change during a manufacturing process for each embodiment, and this is a result of intended steps to reduce/eliminate burrs in the final product. This can be described for each configuration as a change in the configuration of the combined dielectric/resistive layer (or parallel or analogous layers). Such a change in configuration can be a change that is absolute or relative to another element, and may involve only particular regions of the combined dielectric/resistive layer 103 (or parallel or analogous layers) such as edge regions, or an entirety of the combined dielectric/resistive layer 103 (or parallel or analogous layers).

Next, the second sub-assembly 120 can be slip fit by insertion into the second dielectric layer 104 to produce the third sub-assembly 130. The second dielectric layer 104 may be slit-cut, as shown on by the line segment on the right side thereof in FIG. 1A. In the third sub-assembly 130, the small gap in the combined dielectric/resistive layer 103 is closed or substantially closed due to the process of slip fitting the second sub-assembly 120 into the second dielectric layer 104. The intent is to close the small gap, but a minute mechanical gap may still result in the final product. On the other hand, the small slit-cut in the second dielectric layer 104 may remain, even in the hybrid coaxial cable 140 that is the final product.

In FIG. 1A above, the small gap in the combined dielectric/resistive layer 103 is shown aligned to the left of center, whereas the slit-cut in the second dielectric layer 104 is shown aligned to the right of center. The small gap and the slit-cut may be intentionally aligned in this manner 180 degrees from one another for fabrication in order to minimize the likelihood of an air gap in any region. In the event that the small gap in the combined dielectric/resistive layer 103 is not entirely closed, the alignment opposite the small slit-cut in the second dielectric layer 104 may help ensure that any gaps in layers do not overlap. The opposing alignment between the small gap in the combined dielectric/ resistive layer 103 and the small slit cut in the second dielectric layer 104 also helps ensure a more uniform density of the final product around the axis, which in turn helps provide a consistent dielectric that results in consistent mechanical and dielectric effects. Thus, while gaps and slit-cuts may be shown aligned on the same side of center in other embodiments, it will be understood that they can alternatively be aligned 180 degrees from one another for any reason including to minimize the possibility of an air gap.

In a final process in the example above, the outer conductor 105 can be drawn down over the third sub-assembly 130 to produce the hybrid coaxial cable 140. The process of drawing the outer conductor 105 over the third sub-assembly 130 further reduces any gaps such as the small initial gap in the combined dielectric/resistive layer 103 to an electrically small level. Alternatively, the outer conductor 105 can be helically wrapped around the third sub-assembly 130 to produce the hybrid coaxial cable 140. Helical wrapping uses a helically wrapped dielectric. As another alternative, the outer conductor 105 can be braided around the third sub-assembly 130 to produce the hybrid coaxial cable 140. Tension of the wrapped tape dielectric in the helical wrapping process helps reduce gaps in lower layers to an electrically small level. Similarly, tension from the braiding of the outer conductor 105 can help reduce gaps in lower layers to an electrically small level. Which of the alternatives for placing the outer conductor 105 around the third sub-assembly 130 is used may depend on the material type of the outer conductor 105. The outer conductor 105 may be constructed by, for example, conductive flat ribbon, stranded conductor, and solid conductor.

Helical wrapping described herein may also be performed in a manner that minimizes or eliminates gaps. For example, when helical wrapping is performed with multiple layers of wrapping, the starting points of the wrap for each layer may be offset from one another. Similarly, the angle of wrapping may be varied for different layers of wrap. In this way, gaps between the wrap for one layer can be avoided in adjacent layers of wrap.

Figure 1B:
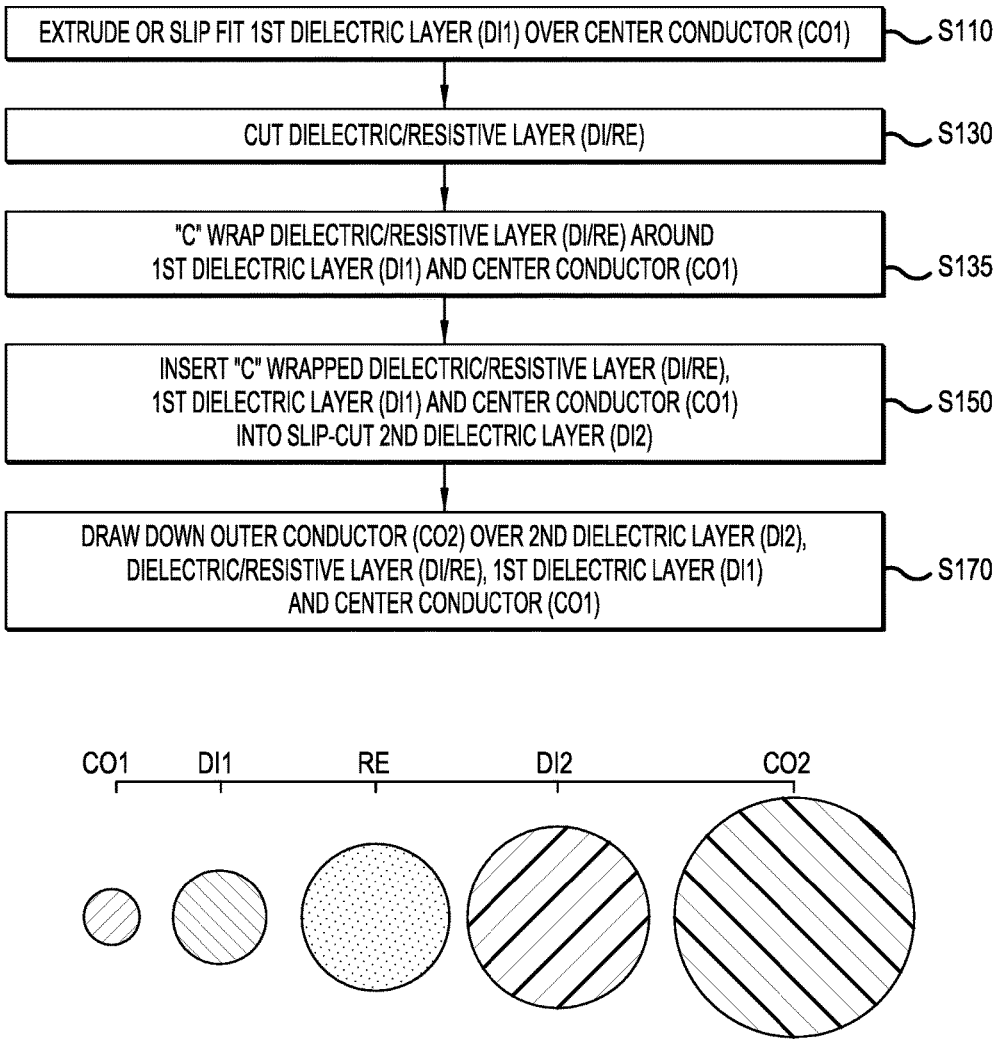
FIG. 1B illustrates a method for manufacturing the hybrid coaxial cable in the embodiment of FIG. 1A in accordance with a representative embodiment.

FIG. 1B illustrates a method for manufacturing the hybrid coaxial cable in the embodiment of FIG. 1A in accordance with a representative embodiment.

In FIG. 1B, the process starts at S110 by extruding or slip fitting the first dielectric layer 102 over the center conductor 101. At S130, the combined dielectric/resistive layer 103 is cut, and at S135 the combined dielectric/resistive layer 103 is wrapped around the first dielectric layer 102 and the center conductor 101. At S150, the wrapped dielectric/resistive layer 103, first dielectric layer 102 and center conductor 101 are inserted into the second dielectric layer 104. The second dielectric layer 104 is slip-cut before the wrapped dielectric/resistive layer 103, first dielectric layer 102 and center conductor 101 are inserted. At S170, the outer conductor 105 is drawn down over the second dielectric layer 104, the combined dielectric/resistive layer 103, the first dielectric layer 102, and the center conductor 101.

In the embodiment of FIGS. 1A and 1B, the combined dielectric/resistive layer 103 has a gap when first cut to a precise and predetermined width and wrapped around the first dielectric layer 102 and center conductor 101. However, the gap in the combined dielectric/resistive layer 103 may disappear when the second sub-assembly 120 is slip fit into the second dielectric layer 104 that is slit cut. On the other hand, the cut in the second dielectric layer 104 that is slit cut may still appear in a cross-sectional view even in the hybrid coaxial cable 140.

Figure 2A:
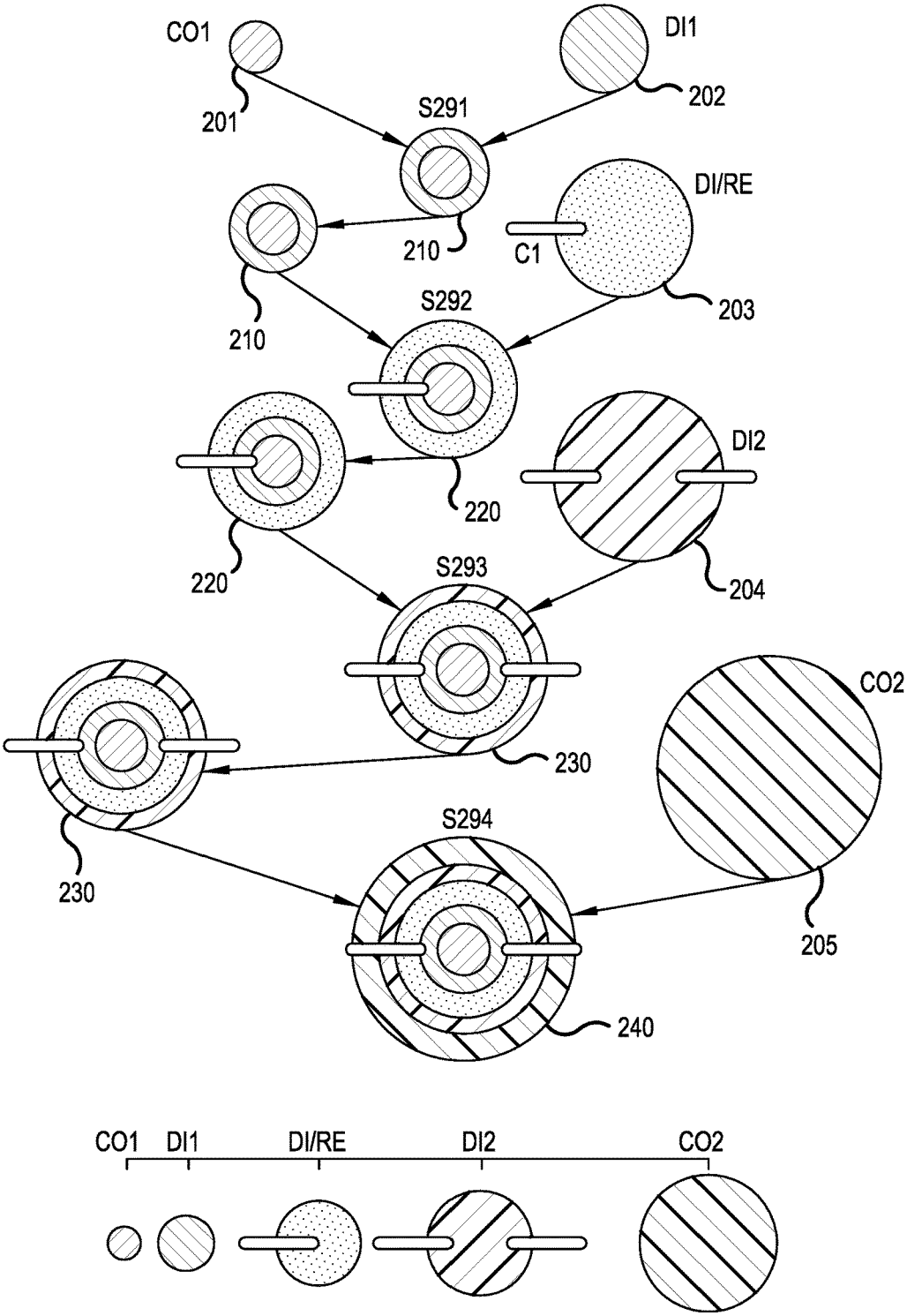
FIG. 2A illustrates hybrid coaxial cable components and another arrangement for manufacturing the hybrid coaxial cable in accordance with a representative embodiment.

FIG. 2A illustrates hybrid coaxial cable components and another arrangement for manufacturing the hybrid coaxial cable in accordance with a representative embodiment.

In FIG. 2A, components of a hybrid coaxial cable under construction include center conductor 201, first dielectric layer 202, a combined dielectric/resistive layer 203, a second dielectric layer 204, and an outer conductor 205. In FIG. 2A, the second dielectric layer 204 is applied as two half-pieces to the third sub-assembly 230 explained below, rather than having the slit-cut in the embodiment of FIGS. 1A and 1B. The term "half-piece" as used herein is representative of a member with two pieces. The two pieces may be of equal dimensions and/or characteristics, of substantially equal (e.g., within 5% of one another) dimensions and/or characteristics, or may have significant differences such as one having dimensions and/or characteristics significantly different from (e.g., up to 150% of) the other. In another embodiment, a member may comprise three pieces.

In FIG. 2A, the first dielectric layer 202 is placed around the center conductor 201 to produce a first sub-assembly 210 at S291. The combined dielectric/resistive layer 203 is placed around the first sub-assembly 210 to produce a second sub-assembly 220 at S292. The second dielectric layer 204 is placed around the second sub-assembly 220 to produce a third sub-assembly 230 at S293. The outer conductor 205 is placed around the third sub-assembly 230 to produce a hybrid coaxial cable 240 at S294.

As an example of the processes in FIG. 2A, the first dielectric layer 202 may be extruded or slip fit over the center conductor 201. The result is first sub-assembly 210 with the center conductor 201 and the first dielectric layer 202 disposed therein. Next, the combined dielectric/resistive layer 203 can be cut to a precise and predetermined width strip or predetermined width strips, and then wrapped around the first sub-assembly 210. When the combined dielectric/resistive layer 203 is wrapped around the first sub-assembly 210, the combined dielectric/resistive layer 203 may initially have the appearance of the letter "C" in that a small gap (e.g., of less than 5% of the width) may be left initially. The small gap is shown by the line segment on the left side of the combined dielectric/resistive layer DI/RE in FIG. 2A. The result of wrapping the combined dielectric/resistive layer 203 is the second sub-assembly 220.

Next, the second sub-assembly 220 can be slip fit by insertion into the second dielectric layer 204 to produce the third sub-assembly 230. The second dielectric layer 204 may be two half-pieces, so that the second sub-assembly 220 may be placed from above onto the lower half-piece, and then the upper half-piece placed on top of the second sub-assembly 220 to close the second dielectric layer 204. The presence of the two half-pieces in FIG. 2A is shown by the lines segments on the right side and the left side thereof in FIG. 2A. In the third sub-assembly 230, the small gap in the combined dielectric/resistive layer 203 is closed or substantially closed due to the process of fitting the second sub-assembly 220 into the two half-pieces of the second dielectric layer 204. The intent is to close the small gap, but a minute mechanical gap may still result in the final product. On the other hand, the presence of small gaps between the two half-pieces may remain, even in the hybrid coaxial cable 240 that is the final product. As noted above, the possibility of overlapping gaps of any magnitude in different material layers is minimized. Initial gaps or slit-cuts may be aligned with uniform angled from the axis. As an example, three (3) different initial gaps and/or slip-cuts may be spaced at 120 degree angles, and four (4) different initial gaps and/or slip-cuts may be spaced at 90 degree angles. Embodiments herein do not show and should not be interpreted as showing overlapping gaps in different material layers.

In a final process in the example above, the outer conductor 205 can be drawn down over the third sub-assembly 230 to produce the hybrid coaxial cable 240. The process of drawing the outer conductor 205 over the third sub-assembly 230 further reduces any gaps such as the small initial gap in the combined dielectric/resistive layer 203 to an electrically small level. Alternatively, the outer conductor 205 can be helically wrapped around the third sub-assembly 230 to produce the hybrid coaxial cable 240. As another alternative, the outer conductor 205 can be braided around the third sub-assembly 230 to produce the hybrid coaxial cable 240. Tension of the wrapped tape dielectric in the helical wrapping process helps reduce gaps in lower layers to an electrically small level. Similarly, tension from the braiding of the outer conductor 205 can help reduce gaps in lower layers to an electrically small level. Which of the alternatives for placing the outer conductor 205 around the third sub-assembly 230 is used may depend on the material type of the outer conductor 205. The outer conductor 205 may be constructed by, for example, conductive flat ribbon, stranded conductor, and solid conductor.

Figure 2B:
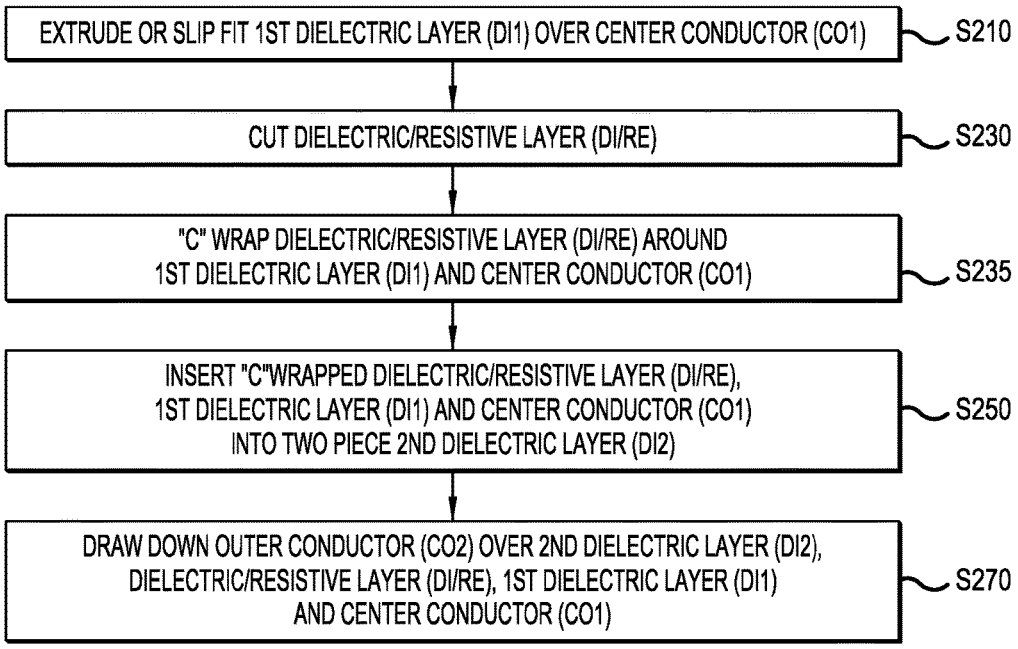
FIG. 2B illustrates a method for manufacturing the hybrid coaxial cable in the embodiment of FIG. 2A in accordance with a representative embodiment.
Figure 2B:
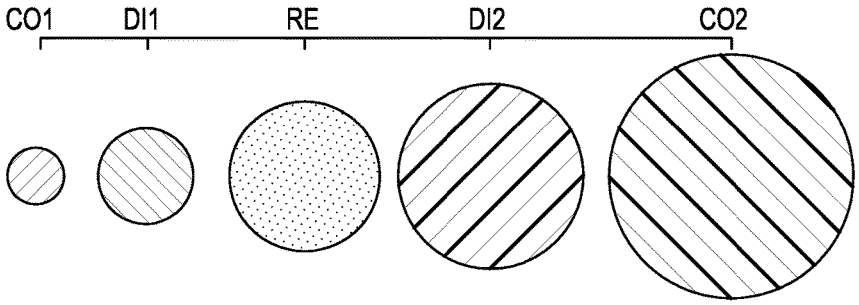

FIG. 2B illustrates a method for manufacturing the hybrid coaxial cable in the embodiment of FIG. 2A in accordance with a representative embodiment.

In FIG. 2B, the process starts at S210 by extruding or slip fitting the first dielectric layer 202 over the center conductor 201. At S230, the combined dielectric/resistive layer 203 is cut, and at S235 the combined dielectric/resistive layer 203 is wrapped around the first dielectric layer 202 and the center conductor 201. At S250, the wrapped dielectric/resistive layer 203, first dielectric layer 202 and center conductor 201 are inserted into the two half-pieces of the second dielectric layer 204. At S270, the outer conductor 205 is drawn down over the second dielectric layer 204, the combined dielectric/resistive layer 203, the first dielectric layer 202, and the center conductor 201.

In the embodiment of FIGS. 2A and 2B, the combined dielectric/resistive layer 203 may have a gap when first cut to a precise and predetermined width and wrapped around the first dielectric layer 202 and center conductor 201. However, the gap in the combined dielectric/resistive layer 203 may disappear when the second sub-assembly 220 is slip fit into the two half-pieces of the second dielectric layer 204. On the other hand, gaps between the two half-pieces of the second dielectric layer 204 may still appear in a cross-sectional view even in the hybrid coaxial cable 240.

Figure 3A:
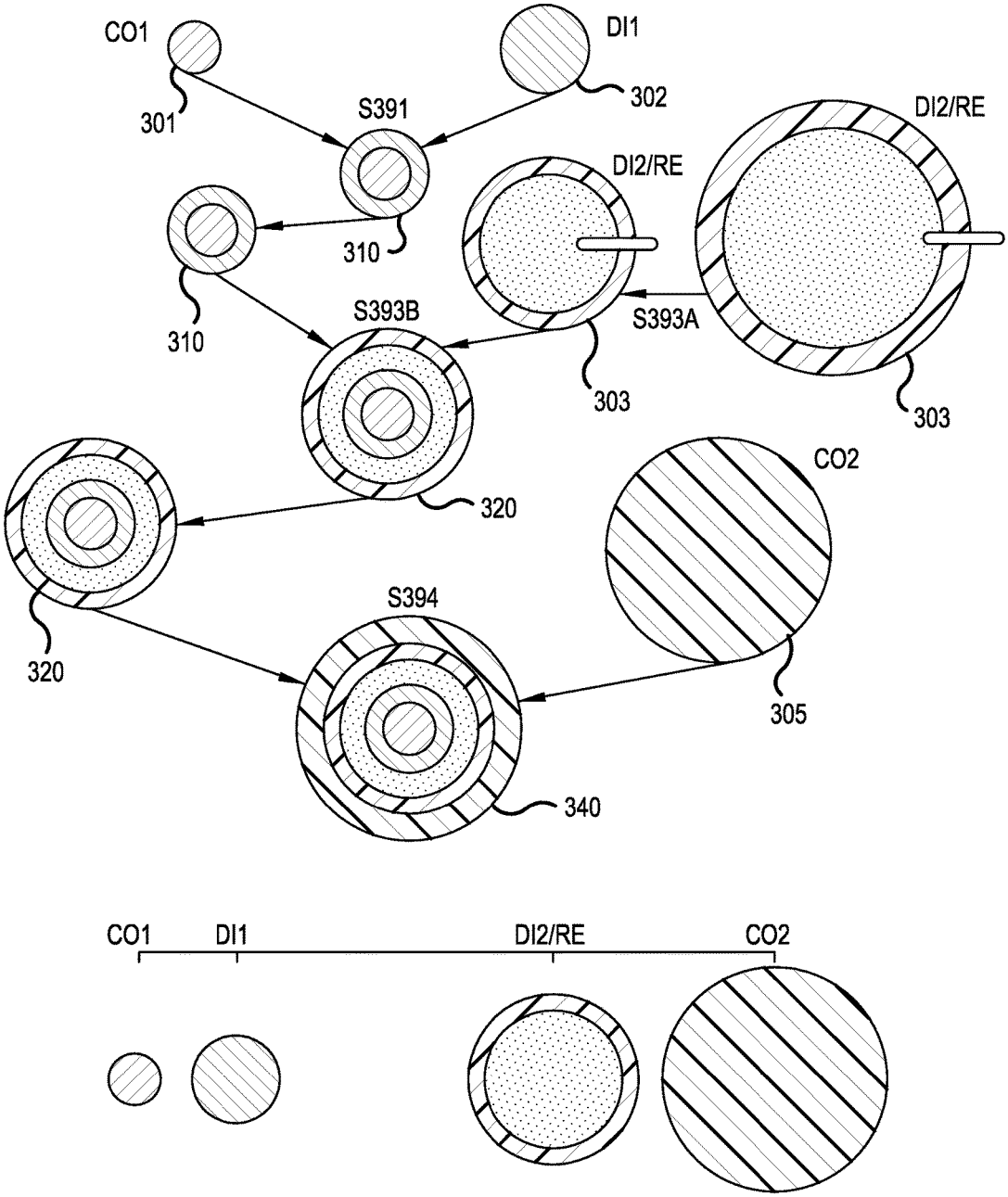
FIG. 3A illustrates hybrid coaxial cable components and another arrangement for manufacturing the hybrid coaxial cable in accordance with a representative embodiment.

FIG. 3A illustrates hybrid coaxial cable components and another arrangement for manufacturing the hybrid coaxial cable in accordance with a representative embodiment.

In FIG. 3A, components of a hybrid coaxial cable under construction include center conductor 301, first dielectric layer 302, a combined second dielectric layer/resistive layer 303, and an outer conductor 305. In FIG. 3A, the combined second dielectric layer/resistive layer 303 is also labeled DI2/RE.

In FIG. 3A, the first dielectric layer 302 is placed around the center conductor 301 to produce a first sub-assembly 310 at S391. The second dielectric layer/resistive layer 303 is shrunk by heat at S393A. Heat shrinking involves shrinking an outer dielectric down over/around an assembly, in this case the first sub-assembly 310. The outer dielectric is the dielectric of the second dielectric layer/resistive layer 303. The shrunken combined second dielectric layer/resistive layer 303 is placed around the first sub-assembly 310 to produce a second sub-assembly 320 at S393B. The outer conductor 304 is placed around the second sub-assembly 320 to produce a hybrid coaxial cable 340 at S394.

As an example of the processes in FIG. 3A, the first dielectric layer 302 may be extruded over the center conductor 301. The result is first sub-assembly 310 with the center conductor 301 and the first dielectric layer 302 disposed therein.

Next, the combined second dielectric layer/resistive layer 303 is cut to a precise and predetermined width strip or predetermined width strips, and then inserted into a heat shrink. When the combined second dielectric layer/resistive layer 303 is inserted into the heat shrink, the combined second dielectric layer/resistive layer 303 may initially have the appearance of the letter "C" in that a small gap (e.g., of less than 5% of the width) may be left initially. The small gap is shown by the line segment on the left side of the combined second dielectric layer/resistive layer DI2/RE in FIG. 3A. The result of heat shrinking the combined second dielectric/layer/resistive layer DI2/RE is the second sub-assembly 320. The small gap in the combined second dielectric layer/resistive layer DI2/RE disappears in the heat shrinking.

In a final process in the example above, the outer conductor 305 can be drawn down over the second sub-assembly 320 to produce the hybrid coaxial cable 340. The process of drawing the outer conductor 305 over the second sub-assembly 320 further reduces any gaps such as the small initial gap in the second dielectric/resistive layer 303 to an electrically small level. Alternatively, the outer conductor 305 can be helically wrapped around the second sub-assembly 320 to produce the hybrid coaxial cable 340. As another alternative, the outer conductor 305 can be braided around the second sub-assembly 320 to produce the hybrid coaxial cable 340. Tension of the wrapped tape dielectric in the helical wrapping process helps reduce gaps in lower layers to an electrically small level. Similarly, tension from the braiding of the outer conductor 305 can help reduce gaps in lower layers to an electrically small level. Which of the alternatives for placing the outer conductor 305 around the second sub-assembly 320 is used may depend on the material type of the outer conductor 305. The outer conductor 305 may be constructed by, for example, conductive flat ribbon, stranded conductor, and solid conductor.

Figure 3B:
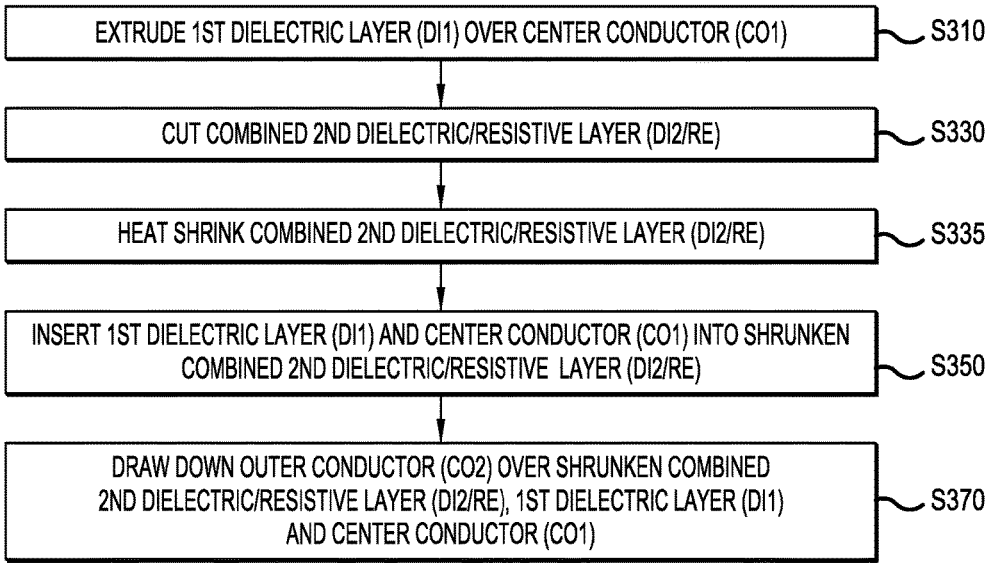
FIG. 3B illustrates a method for manufacturing the hybrid coaxial cable in the embodiment of FIG. 3A in accordance with a representative embodiment.
Figure 3B:
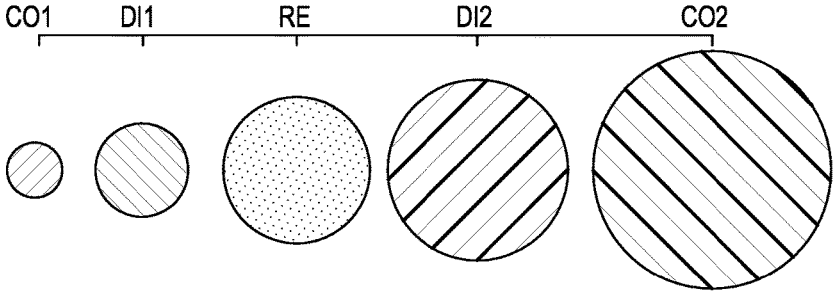

FIG. 3B illustrates a method for manufacturing the hybrid coaxial cable in the embodiment of FIG. 3A in accordance with a representative embodiment.

In FIG. 3B, the process starts at S310 by extruding the first dielectric layer 302 over the center conductor 301. At S330, the combined second dielectric layer/resistive layer 303 is cut, and at S335 the combined second dielectric layer/resistive layer 303 is heat shrunk around the first dielectric layer 302 and the center conductor 301. At S350, the first dielectric layer 302 and center conductor 301 are inserted into the second dielectric layer/resistive layer 303 that is heat shrunken. At S370, the outer conductor 305 is drawn down over the second dielectric layer/resistive layer 303, the first dielectric layer 302, and the center conductor 301.

In the embodiment of FIGS. 3A and 3B, the combined second dielectric layer/resistive layer 303 has a gap when first cut to a precise and predetermined width and inserted into the heat shrink. However, the gap in the combined second dielectric layer/resistive layer 303 may disappear in the heat shrinking.

Figure 4A:
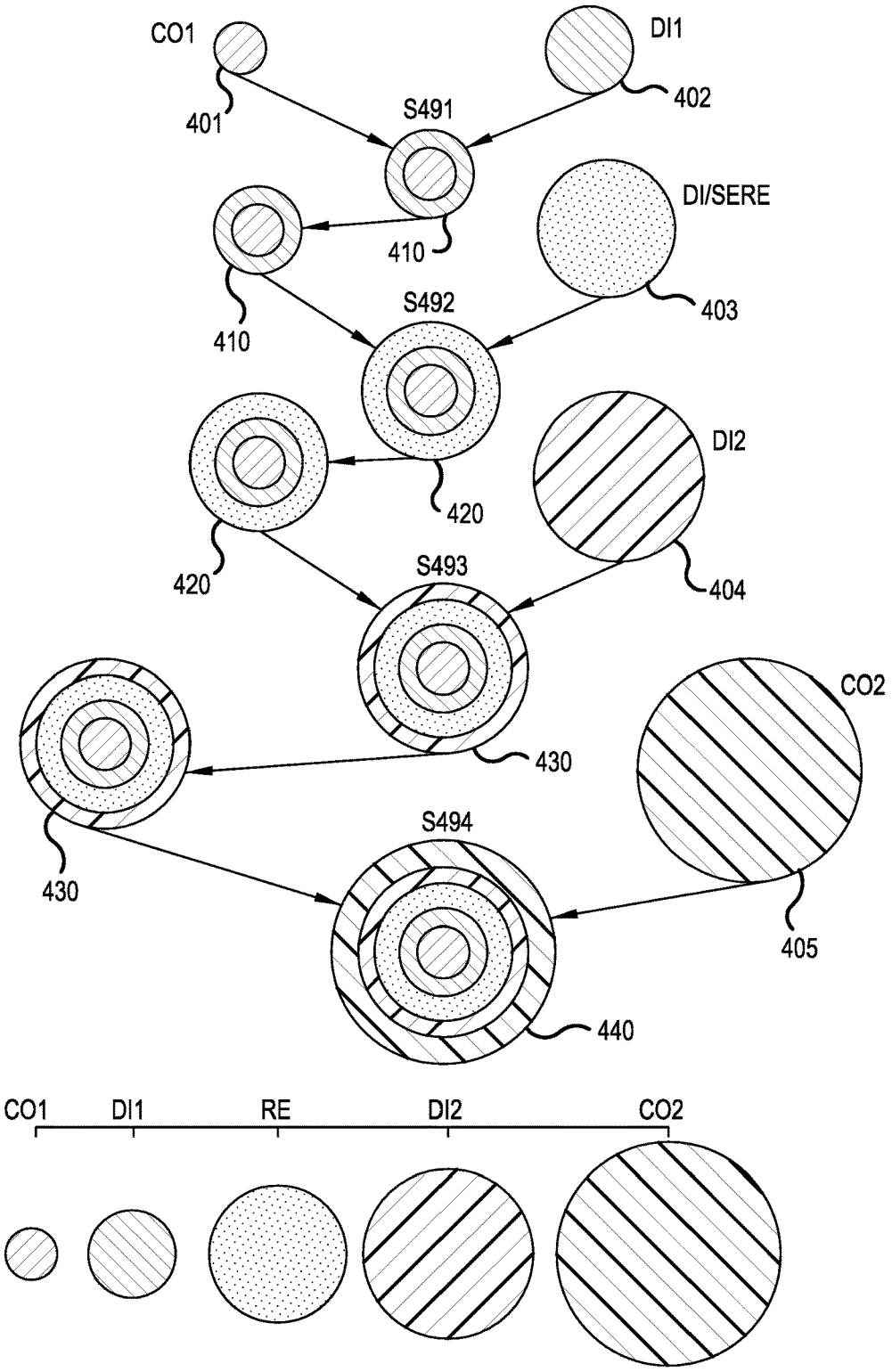
FIG. 4A illustrates hybrid coaxial cable components and another arrangement for manufacturing the hybrid coaxial cable in accordance with a representative embodiment.

FIG. 4A illustrates hybrid coaxial cable components and another arrangement for manufacturing the hybrid coaxial cable in accordance with a representative embodiment.

In FIG. 4A, components of a hybrid coaxial cable under construction include center conductor 401, first dielectric layer 402, a combined dielectric/resistive layer 403, a second dielectric layer 404, and an outer conductor 405.

In FIG. 4A, the first dielectric layer 402 is placed around the center conductor 401 to produce a first sub-assembly 410 at S491. The combined dielectric/resistive layer 403 is placed around the first sub-assembly 410 to produce a second sub-assembly 420 at S492. The second dielectric layer 404 is placed around the second sub-assembly 420 to produce a third sub-assembly 430 at S493. The outer conductor 405 is placed around the third sub-assembly 430 to produce a hybrid coaxial cable 440 at S494.

As an example of the processes in FIG. 4A, the first dielectric layer 402 may be extruded over the center conductor 401. The result is first sub-assembly 410 with the center conductor 401 and the first dielectric layer 402 disposed therein.

Next, the combined dielectric/resistive layer 403 can be cut to a precise and predetermined width strip or predetermined width strips, and then helically wrapped around the first sub-assembly 410. Alternatively, the combined dielectric/resistive layer 403 can be cut to a precise and predetermined width strip or predetermined width strips and deposited directly onto the first sub-assembly 410. When the combined dielectric/resistive layer 403 is helically wrapped around or deposited on the first sub-assembly 410, the combined dielectric/resistive layer 403 will not have the appearance of the letter "C" from earlier embodiments, even initially. The result of wrapping or depositing directly the combined dielectric/resistive layer 403 is the second sub-assembly 420. As noted previously, helical wrapping described herein may also be performed in a manner that minimizes or eliminates gaps. In this way, multiple layers of wrap may be provided with different starting points and/or different angles of wrapping.

Next, the second dielectric layer 404 is extruded over the second sub-assembly to produce the third sub-assembly 430. Unlike earlier embodiments, the second dielectric layer 404 is not slit-cut in an embodiment, though it may be in another embodiment consistent with FIGS. 4A and 4B. Extruding generally results in filling gaps to be essentially void-less, and this is true for the second dielectric layer 404 when it is extruded over the second sub-assembly.

In a final process in the example above, the outer conductor 405 can be drawn down over the third sub-assembly 430 to produce the hybrid coaxial cable 440. The process of drawing the outer conductor 405 over the third sub-assembly 430 further reduces any gaps from helical wrapping or any other process resulting in the lower layers. Alternatively, the outer conductor 405 can be helically wrapped around the third sub-assembly 430 to produce the hybrid coaxial cable 440. As another alternative, the outer conductor 405 can be braided around the third sub-assembly 430 to produce the hybrid coaxial cable 440. Tension of the wrapped tape dielectric in the helical wrapping process helps reduce gaps in lower layers to an electrically small level. Similarly, tension from the braiding of the outer conductor 405 can help reduce gaps in lower layers to an electrically small level. Which of the alternatives for placing the outer conductor 405 around the third sub-assembly 430 is used may depend on the material type of the outer conductor 405. The outer conductor 405 may be constructed by, for example, conductive flat ribbon, stranded conductor, and solid conductor.

Figure 4B:
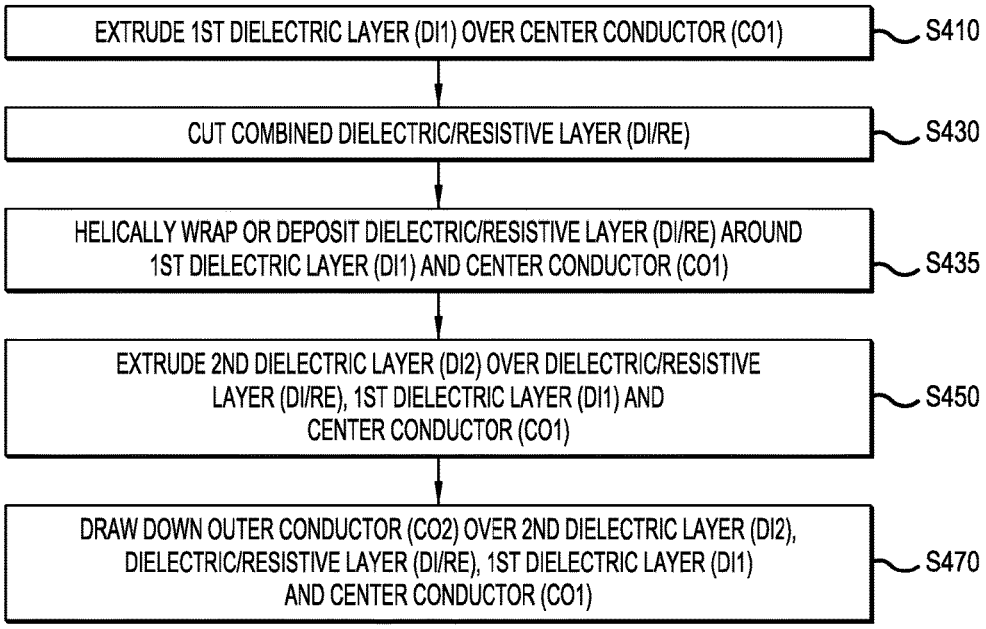
FIG. 4B illustrates a method for manufacturing the hybrid coaxial cable in the embodiment of FIG. 4A in accordance with a representative embodiment.
Figure 4B:
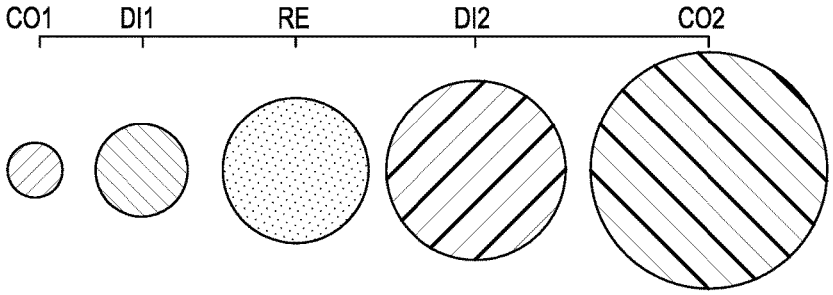

FIG. 4B illustrates a method for manufacturing the hybrid coaxial cable in the embodiment of FIG. 4A in accordance with a representative embodiment.

In FIG. 4B, the process starts at S410 by extruding the first dielectric layer 402 over the center conductor 401. At S430, the combined dielectric/resistive layer 403 is cut, and at S435 the combined dielectric/resistive layer 403 is helically wrapped or deposited around or on the first dielectric layer 402 and the center conductor 401. At S450, the second dielectric layer 404 is extruded over the helically wrapped or deposited dielectric/resistive layer 403, first dielectric layer 402 and center conductor 401. At S470, the outer conductor 405 is drawn down over the second dielectric layer 404, the combined dielectric/resistive layer 403, the first dielectric layer 402, and the center conductor 401.

In the embodiment of FIGS. 4A and 4B, the helical wrapping or deposition at S435 avoids the initial gap of previous embodiments. Additionally, the extrusion at S450 avoids the slit cut also of previous embodiments. Accordingly, the hybrid coaxial cable 440 that results in FIG. 4A does not have the legacy of any gap or cut from the components provided therein.

Figure 5:
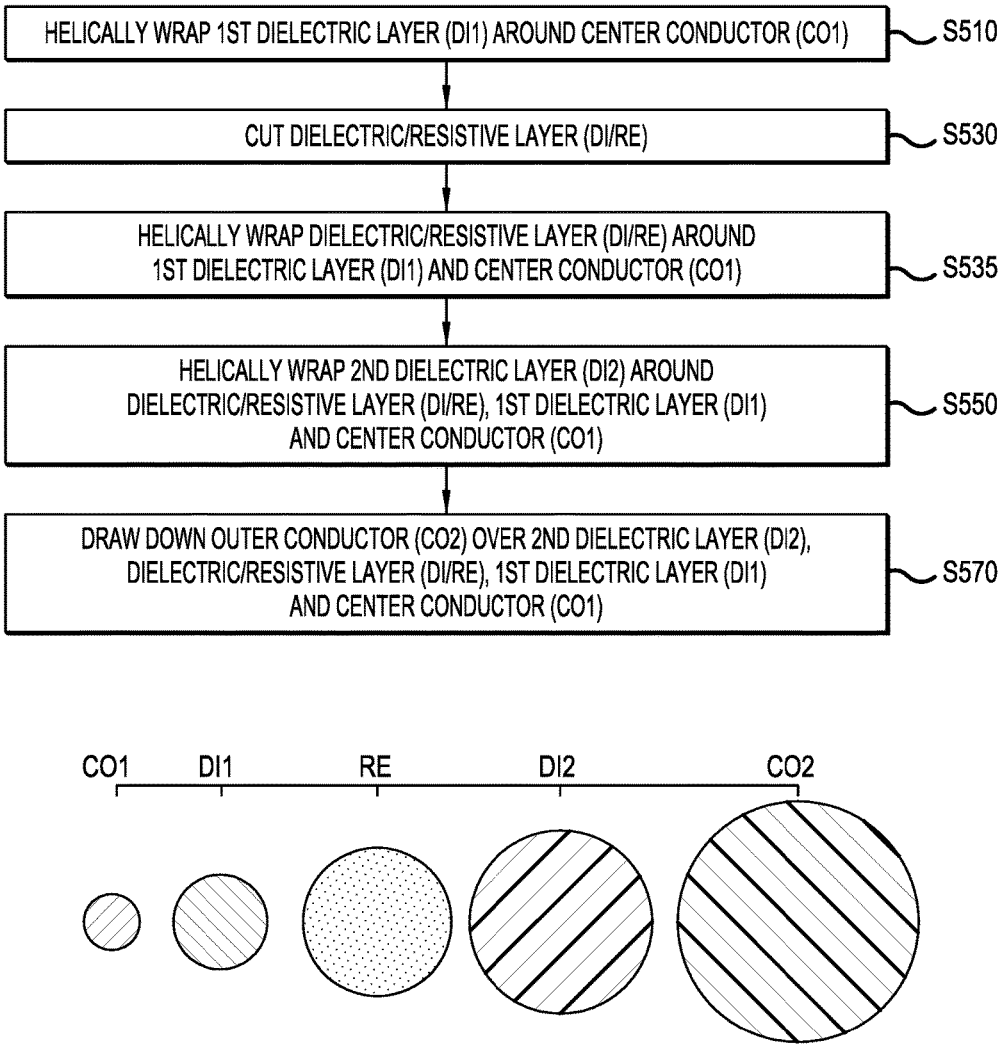
FIG. 5 illustrates another method for manufacturing the hybrid coaxial cable in accordance with a representative embodiment.

FIG. 5 illustrates another method for manufacturing the hybrid coaxial cable in accordance with a representative embodiment.

In FIG. 5, the process starts at S510 by helically wrapping the first dielectric layer (DI1) around the center conductor CO1. At S530, the dielectric/resistive layer (DI/RE) is cut. At S535, the dielectric/resistive layer (DI/RE) is helically wrapped around the first dielectric layer (DI1) and the center conductor (CO1). At S550, the second dielectric layer (DI2) is helically wrapped around the dielectric/resistive layer (DI/RE), the first dielectric layer (DI1) and the center conductor (CO1). For example, the second dielectric layer (DI2) may be provided as helical dielectric tape that can be wrapped around the dielectric/resistive layer (DI/RE). At S570, the outer conductor (CO2) is drawn down over the second dielectric layer (DI2), dielectric/resistive layer (DI/RE), first dielectric layer (DI1), and center conductor (CO1). The result of S570 is a hybrid coaxial cable.

In the embodiment of FIG. 5, none of the components of the resultant hybrid coaxial cable has a gap or slit cut in the depth direction at any stage of processing. This is not to say that this is a requirement; rather, this is to say that a gap or slit cut does not serve any apparent purpose in the embodiment of FIG. 5 due to the more extensive use of helical wrapping techniques.

Figure 6A:
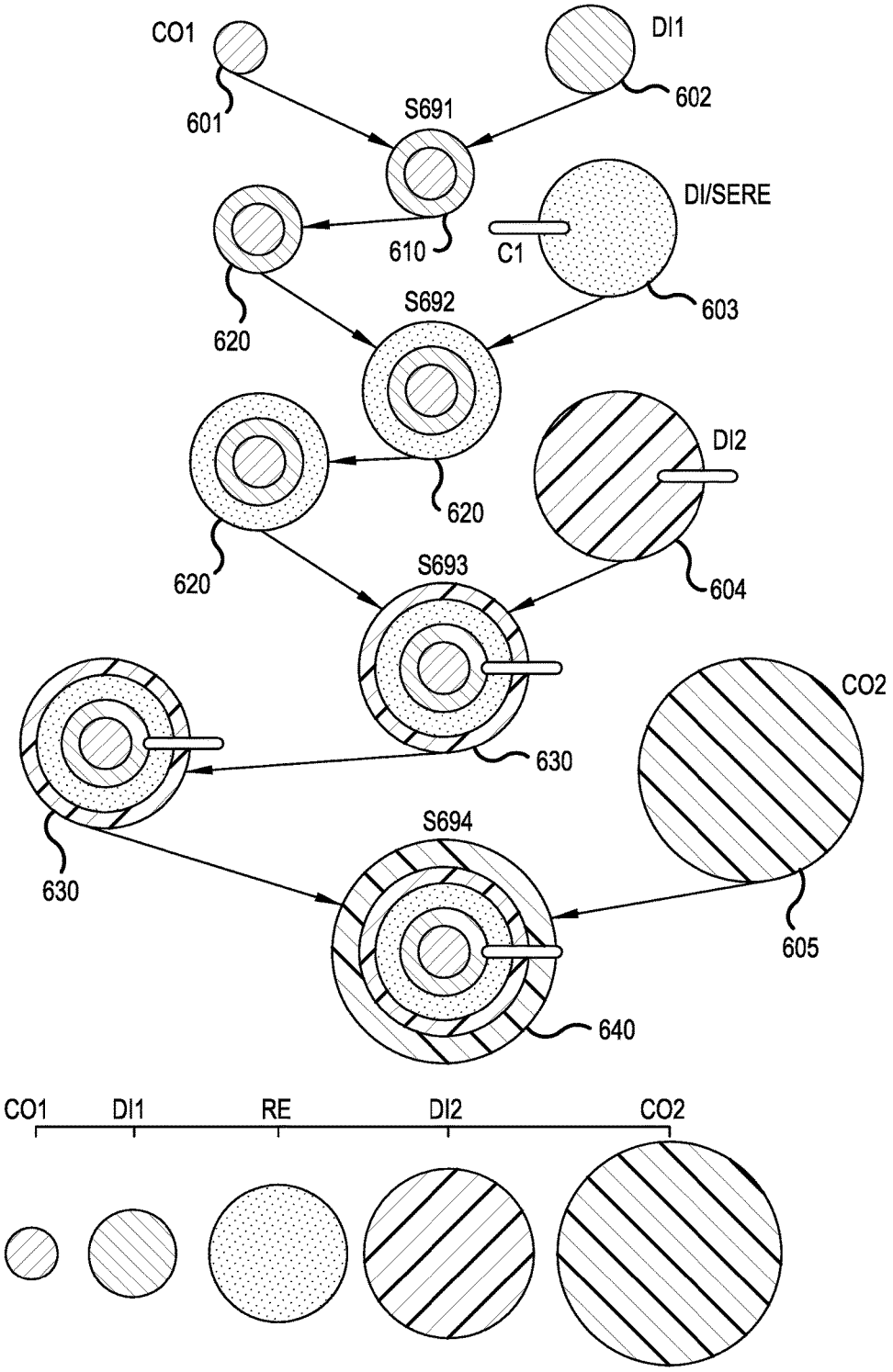
FIG. 6A illustrates hybrid coaxial cable components and another arrangement for manufacturing the hybrid coaxial cable in accordance with a representative embodiment.

FIG. 6A illustrates hybrid coaxial cable components and another arrangement for manufacturing the hybrid coaxial cable in accordance with a representative embodiment.

In FIG. 6A, components of a hybrid coaxial cable under construction include center conductor 601, first dielectric layer 602, a combined dielectric/patterned resistive layer 603, a second dielectric layer 604, and an outer conductor 605. In FIG. 6A, the combined dielectric/patterned resistive layer 603 is also labeled DI/PARE.

In FIG. 6A, the first dielectric layer 602 is placed around the center conductor 601 to produce a first sub-assembly 610 at S691. The combined dielectric/patterned resistive layer 603 is placed around the first sub-assembly 610 to produce a second sub-assembly 620 at S692. The second dielectric layer 604 is placed around the second sub-assembly 620 to produce a third sub-assembly 630 at S693. The outer conductor 605 is placed around the third sub-assembly 630 to produce a hybrid coaxial cable 640 at S694.

As an example of the processes in FIG. 6A, the first dielectric layer 602 may be extruded or slip fit over the center conductor 601. The result is first sub-assembly 610 with the center conductor 601 and the first dielectric layer 602 disposed therein.

Next, the combined dielectric/patterned resistive layer 603 can be cut to a precise and predetermined width strip or predetermined width strips, and then wrapped around the first sub-assembly 610. When the combined dielectric/patterned resistive layer 603 is wrapped around the first sub-assembly 610, the combined dielectric/patterned resistive layer 603 may initially have the appearance of the letter "C" in that a small gap (e.g., of less than 5% of the width) may be left initially. The small gap is shown by the line segment on the left side of the combined dielectric/resistive layer DI/PARE in FIG. 6A. The result of wrapping the combined dielectric/patterned resistive layer 603 is the second sub-assembly 620.

Next, the second sub-assembly 620 can be slip fit by insertion into the second dielectric layer 604 to produce the third sub-assembly 630. The second dielectric layer 604 may be slit-cut, as shown on by the line segment on the right side thereof in FIG. 6A. In the third sub-assembly 630, the small gap in the combined dielectric/patterned resistive layer 603 is closed or substantially closed due to the process of slip fitting the second sub-assembly 620 into the second dielectric layer 604. However, the small slit-cut in the second dielectric layer 604 may remain, even in the hybrid coaxial cable 640 that is the final product.

In FIG. 6A above, the small gap in the combined dielectric/patterned resistive layer 603 is shown aligned to the left of center, whereas the slit-cut in the second dielectric layer 604 is shown aligned to the right of center. The small gap and the slit-cut may be intentionally aligned in this manner 180 degrees from one another for fabrication in order to minimize the likelihood of an air gap in any regions, and particularly any air-gap that extends between more than one layer. The opposing alignment between the small gap in the combined dielectric/patterned resistive layer 603 and the second dielectric layer 604 also helps ensure a more uniform density of the final product around the axis, which in turn helps provide a consistent dielectric that results in consistent mechanical and dielectric effects. While gaps and slit-cuts could also be aligned in another manner, in other embodiments, it will be understood that they can be aligned 180 degrees from one another as shown for any reason including to minimize the possibility of an air gap. Gaps and/or slit-cuts can also be aligned at different uniform angles such as 120 degrees, 90 degrees, 72 degrees, 60 degrees and so on depending on the number of gaps and/or slit cuts in the different layers.

In a final process in the example above, the outer conductor 605 can be drawn down over the third sub-assembly 630 to produce the hybrid coaxial cable 640. The process of drawing the outer conductor 605 over the third sub-assembly 630 further reduces any gaps such as the small initial gap in the combined dielectric/patterned resistive layer 603 to an electrically small level. Alternatively, the outer conductor 605 can be helically wrapped around the third sub-assembly 630 to produce the hybrid coaxial cable 640. As another alternative, the outer conductor 605 can be braided around the third sub-assembly 630 to produce the hybrid coaxial cable 640. Tension of the wrapped tape dielectric in the helical wrapping process helps reduce gaps in lower layers to an electrically small level. Similarly, tension from the braiding of the outer conductor 605 can help reduce gaps in lower layers to an electrically small level. Which of the alternatives for placing the outer conductor 605 around the third sub-assembly 630 is used may depend on the material type of the outer conductor 605. The outer conductor 605 may be constructed by, for example, conductive flat ribbon, stranded conductor, and solid conductor.

Figure 6B:
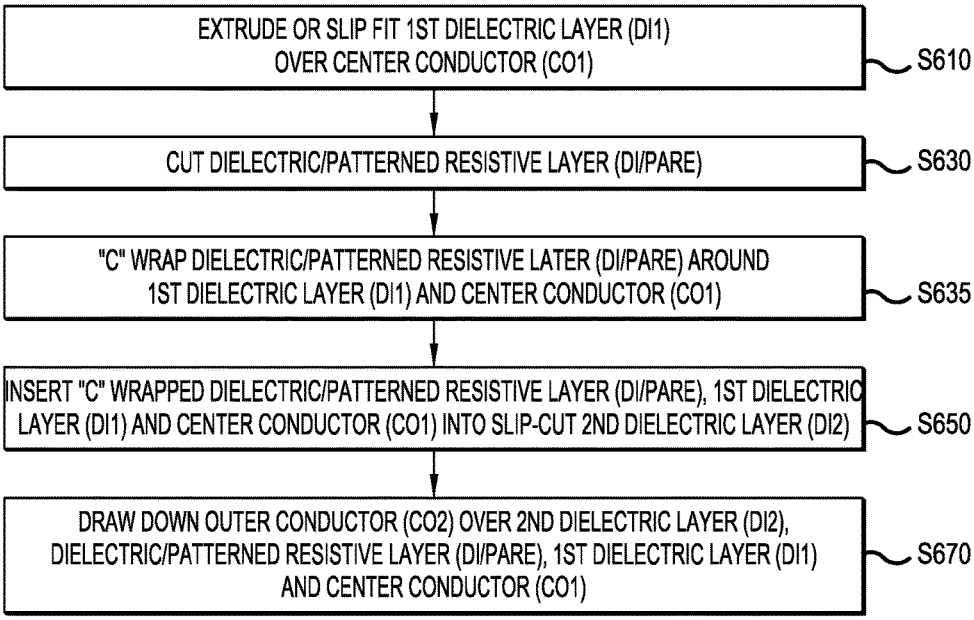
FIG. 6B illustrates a method for manufacturing the hybrid coaxial cable in the embodiment of FIG. 6A in accordance with a representative embodiment.

FIG. 6B illustrates a method for manufacturing the hybrid coaxial cable in the embodiment of FIG. 6A in accordance with a representative embodiment.

In FIG. 6B, the process starts at S610 by extruding or slip fitting the first dielectric layer 602 over the center conductor 601. At S630, the combined dielectric/patterned resistive layer 603 is cut, and at S635 the combined dielectric/patterned resistive layer 603 is wrapped around the first dielectric layer 602 and the center conductor 601. At S650, the wrapped dielectric/patterned resistive layer 603, first dielectric layer 602 and center conductor 601 are inserted into the second dielectric layer 604. The second dielectric layer 604 is slip-cut before the wrapped dielectric/patterned resistive layer 603, first dielectric layer 602 and center conductor 601 are inserted. At S670, the outer conductor 605 is drawn down over the second dielectric layer 604, the combined dielectric/patterned resistive layer 603, the first dielectric layer 602, and the center conductor 601.

In the embodiment of FIGS. 6A and 6B, the dielectric/patterned resistive layer 603 is patterned so that the resistance of the resistive sheet is not uniform throughout. The pattern may be a predetermined pattern, such as a predetermined pattern that is used repeatedly for different resistive sheets for different coaxial cables. The patterned fabrication uses a specific replicated pattern on the dielectric/patterned resistive layer 603, to achieve the desired performance such as to meet predetermined thresholds of specified performance characteristics. For example, a material may be applied depth-wise in lines to create the dielectric/patterned resistive layer 603. The lines may give the dielectric/patterned resistive layer 603 the appearance of being striped. Other patterns can alternatively be applied to the dielectric/patterned resistive layer 603, and may be formed for a number of reasons including to reduce costs of an expensive material, to achieve a particular electromagnetic effect, to reduce a mechanical effect such as stiffness of the dielectric/patterned resistive layer 603, or any number of reasons. In any event, the pattern in the dielectric/patterned resistive layer 603 is specifically not a uniform pattern of the same resistive material with the same characteristics throughout. Additionally, in FIG. 6A, the combined dielectric/patterned resistive layer 603 has a gap when first cut to a precise and predetermined width and wrapped around the first dielectric layer 602 and center conductor 601. However, the gap in the combined dielectric/patterned resistive layer 603 may disappear when the second sub-assembly 620 is slip fit into the second dielectric layer 604 that is slit cut. On the other hand, the cut in the second dielectric layer 604 that is slit cut may still appear in a cross-sectional view even in the hybrid coaxial cable 640.

Figure 7A:
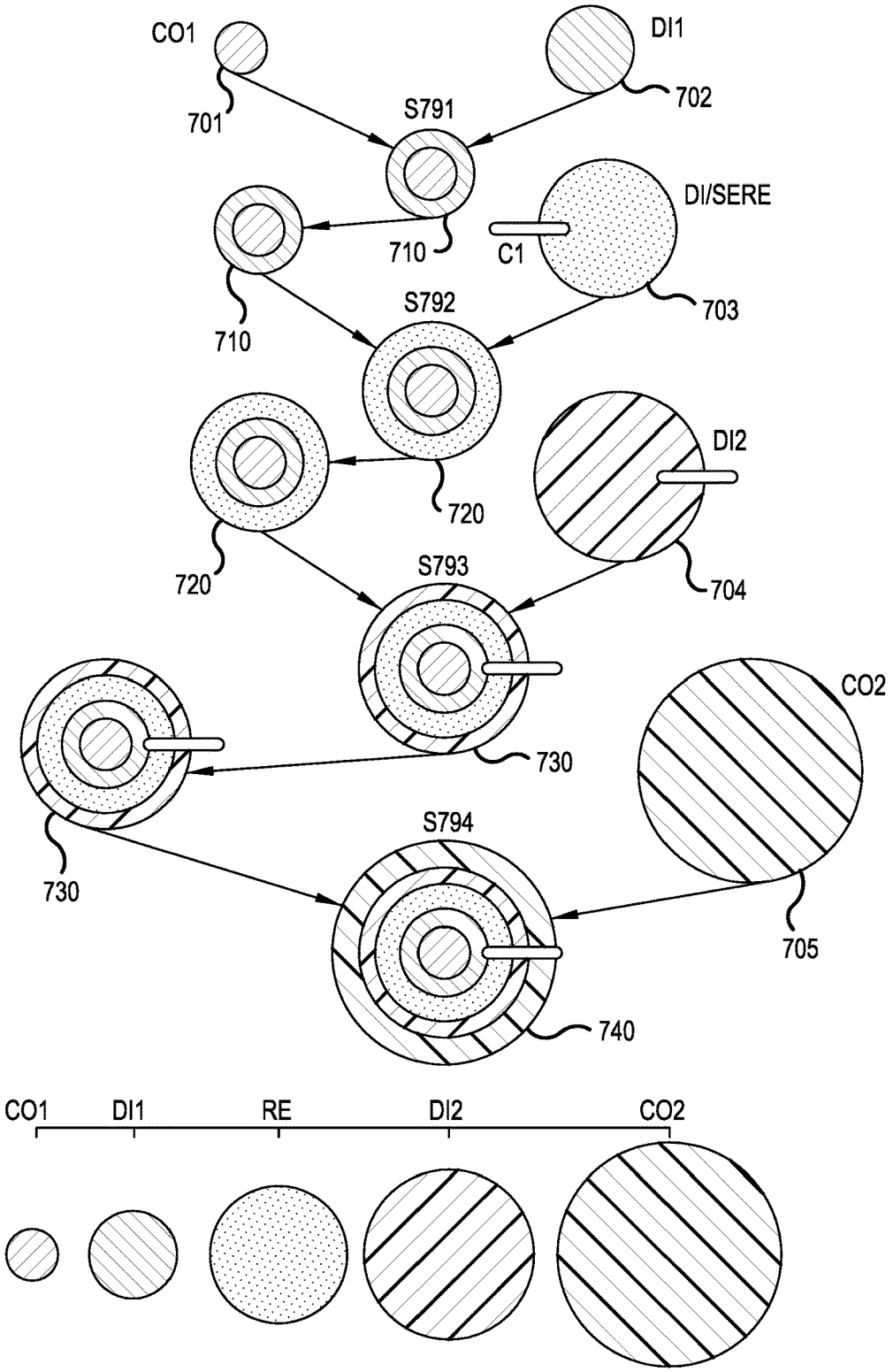
FIG. 7A illustrates hybrid coaxial cable components and another arrangement for manufacturing the hybrid coaxial cable in accordance with a representative embodiment.

FIG. 7A illustrates hybrid coaxial cable components and another arrangement for manufacturing the hybrid coaxial cable in accordance with a representative embodiment.

In FIG. 7A, components of a hybrid coaxial cable under construction include center conductor 701, first dielectric layer 702, a combined dielectric/selective resistive layer 703, a second dielectric layer 704, and an outer conductor 705. In FIG. 7A, the combined dielectric/selective resistive layer 703 is also labeled DI/SERE. in a combined dielectric/selective resistive layer 703, resistive materials may be placed only on selected regions of a dielectric substrate when building the combined dielectric/selective resistive layer 703.

In FIG. 7A, the first dielectric layer 702 is placed around the center conductor 701 to produce a first sub-assembly 710 at S791. The combined dielectric/selective resistive layer 703 is placed around the first sub-assembly 710 to produce a second sub-assembly 720 at S792. The second dielectric layer 704 is placed around the second sub-assembly 720 to produce a third sub-assembly 730 at S793. The outer conductor 705 is placed around the third sub-assembly 730 to produce a hybrid coaxial cable 740 at S794.

As an example of the processes in FIG. 7A, the first dielectric layer 702 may be extruded or slip fit over the center conductor 701. The result is first sub-assembly 710 with the center conductor 701 and the first dielectric layer 702 disposed therein.

Next, the combined dielectric/selective resistive layer 703 can be cut to a precise and predetermined width strip or predetermined width strips, and then wrapped around the first sub-assembly 710. When the combined dielectric/selective resistive layer 703 is wrapped around the first sub-assembly 710, the combined dielectric/selective resistive layer 703 may initially have the appearance of the letter "C" in that a small gap (e.g., of less than 5% of the width) may be left initially. The small gap is shown by the line segment on the left side of the combined dielectric/selective resistive layer DI/RE in FIG. 7A. The result of wrapping the combined dielectric/selective resistive layer 703 is the second sub-assembly 720.

Next, the second sub-assembly 720 can be slip fit by insertion into the second dielectric layer 704 to produce the third sub-assembly 730. The second dielectric layer 704 may be slit-cut, as shown on by the line segment on the right side thereof in FIG. 7A. In the third sub-assembly 730, the small gap in the combined dielectric/selective resistive layer 703 is closed or substantially closed due to the process of slip fitting the second sub-assembly 720 into the second dielectric layer 704. However, the small slit-cut in the second dielectric layer 704 may remain, even in the hybrid coaxial cable 740 that is the final product. The initial gap in the combined dielectric/selective resistive layer 703 is shown aligned to the left, and the slit-cut for the second dielectric layer 704 is shown aligned to the right. As with the embodiments of FIGS. 1A and 6A, this does not necessarily have to be true, but providing the initial gap and the slit-cut on opposite sides may help minimize the risk of an air gap in any region. As noted elsewhere, the underlying intent is to avoid overlapping gaps in different layers, as well as to obtain a substantially uniform density with equal distribution around the axis.

In a final process in the example above, the outer conductor 705 can be drawn down over the third sub-assembly 730 to produce the hybrid coaxial cable 740. The process of drawing the outer conductor 705 over the third sub-assembly 730 further reduces any gaps such as the small initial gap in the combined dielectric/selective resistive layer 703 to an electrically small level. Alternatively, the outer conductor 705 can be helically wrapped around the third sub-assembly 730 to produce the hybrid coaxial cable 740. As another alternative, the outer conductor 705 can be braided around the third sub-assembly 730 to produce the hybrid coaxial cable 740. Tension of the wrapped tape dielectric in the helical wrapping process helps reduce gaps in lower layers to an electrically small level. Similarly, tension from the braiding of the outer conductor 705 can help reduce gaps in lower layers to an electrically small level. Which of the alternatives for placing the outer conductor 705 around the third sub-assembly 730 is used may depend on the material type of the outer conductor 705. The outer conductor 705 may be constructed by, for example, conductive flat ribbon, stranded conductor, and solid conductor.

Figure 7B:
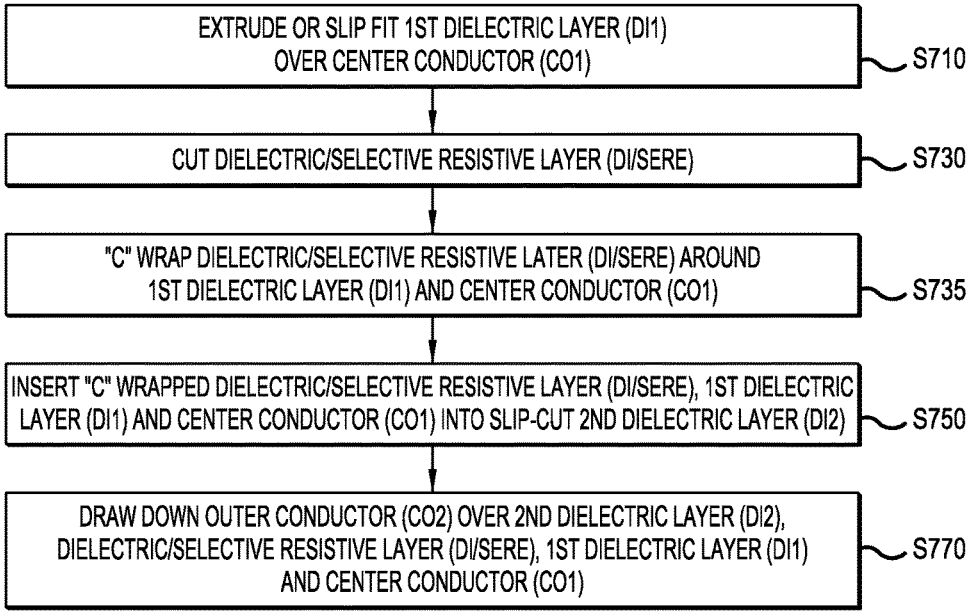
FIG. 7B illustrates a method for manufacturing the hybrid coaxial cable in the embodiment of FIG. 7A in accordance with a representative embodiment.

FIG. 7B illustrates a method for manufacturing the hybrid coaxial cable in the embodiment of FIG. 7A in accordance with a representative embodiment.

In FIG. 7B, the process starts at S710 by extruding or slip fitting the first dielectric layer 702 over the center conductor 701. At S730, the combined dielectric/selective resistive layer 703 is cut, and at S735 the combined dielectric/selective resistive layer 703 is wrapped around the first dielectric layer 702 and the center conductor 701. At S750, the wrapped dielectric/selective resistive layer 703, first dielectric layer 702 and center conductor 701 are inserted into the second dielectric layer 704. The second dielectric layer 704 is slip-cut before the wrapped dielectric/selective resistive layer 703, first dielectric layer 702 and center conductor 701 are inserted. At S770, the outer conductor 705 is drawn down over the second dielectric layer 704, the combined dielectric/selective resistive layer 703, the first dielectric layer 702, and the center conductor 701.

In the embodiment of FIGS. 7A and 7B, the dielectric/selective resistive layer 703 may be applied as an alternative to the dielectric/patterned resistive layer 603 in the embodiment of FIGS. 6A and 6B. A specific region of the resistive material in the dielectric/selective resistive layer 703 may be removed to achieve the desired performance such as to meet predetermined thresholds of specified performance characteristics. The selective resistance itself may be provided by, for example, applying a resistive material selectively onto a dielectric substrate to produce the dielectric/selective resistive layer 703. An example of the dielectric/selective resistive layer 703 includes selective applying the resistive material in lines along the length of the dielectric/selective resistive layer 703, such as on opposite ends of the layer. Additionally, the combined dielectric/resistive layer 703 has a gap when first cut to a precise and predetermined width and wrapped around the first dielectric layer 702 and center conductor 701. However, the gap in the combined dielectric/selective resistive layer 703 may disappear when the second sub-assembly 720 is slip fit into the second dielectric layer 704 that is slit cut. On the other hand, the cut in the second dielectric layer 704 that is slit cut may still appear in a cross-sectional view even in the hybrid coaxial cable 740.

Figure 8:
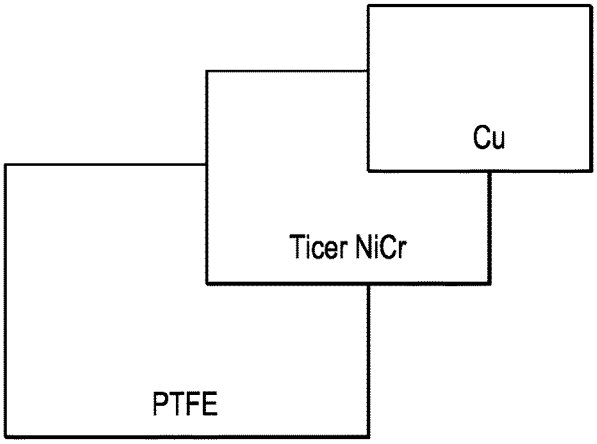
FIG. 8 illustrates resistive sheet components and an arrangement for manufacturing a resistive sheet in accordance with a representative embodiment.
Figure 8:
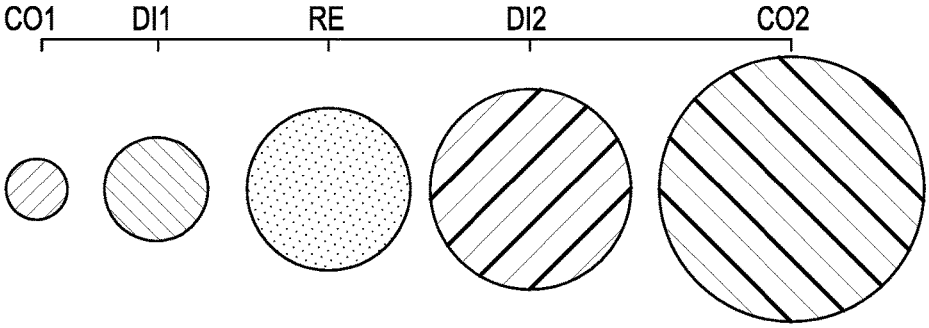

FIG. 8 illustrates resistive sheet components and an arrangement for manufacturing a resistive sheet in accordance with a representative embodiment.

In FIG. 8, an example of a dielectric/resistive layer is shown. In order, the layers include a dielectric substrate, a resistive material (Ticer NiCr), and a copper top layer. The dielectric substrate may be PTFE with a thickness of, for example, 2 millimeters. The resistive material may be Ticer nickel chromium (NiCr) with a resistivity of, for example, 50 ohms/square. The coper top layer may be provided with a thickness of, for example, 1 millimeter.

In FIG. 8, the resistive material may be laminated or otherwise bonded to a dielectric substrate. The dielectric/resistive layer in FIG. 8 may be mass-produced and obtained as a manufacturing input for the hybrid coaxial cables described herein, or may be manufactured as part of the process of manufacturing the hybrid coaxial cables described herein.

Figure 9A:
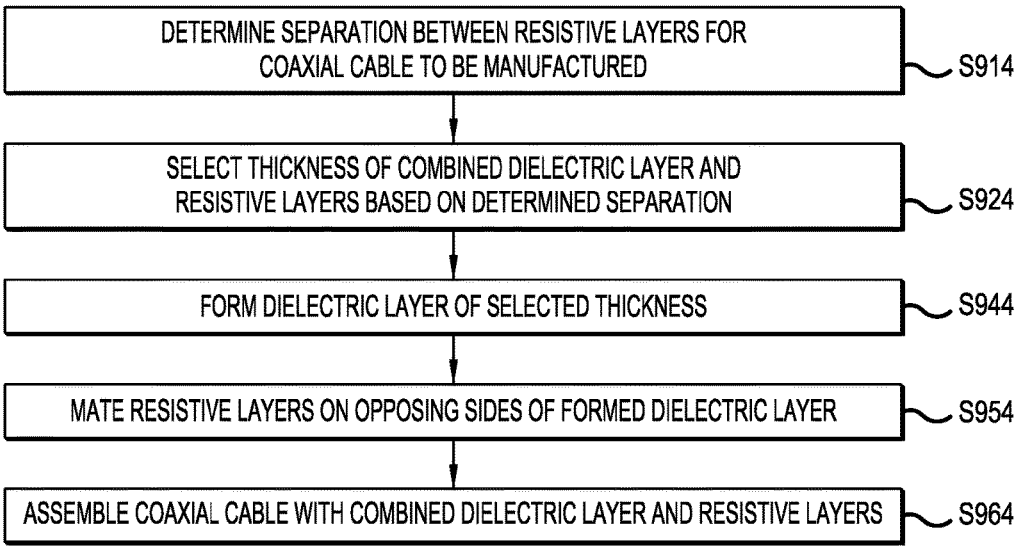
FIG. 9A illustrates another method for manufacturing the hybrid coaxial cable in accordance with a representative embodiment.

FIG. 9A illustrates another method for manufacturing the hybrid coaxial cable in accordance with a representative embodiment.

In FIG. 9A, the method starts at S914 by determining a separation between resistive layers for a coaxial cable to be manufactured. Notably, the underlying reasons for determining the separation is that two (or more) resistive layers will be used in the coaxial cable to be manufactured. The radial distance between resistive layers may be carefully selected based on a determination of an intended use of the coaxial cable to be manufactured. For example, a radial distance between multiple resistive layers may be selected based on the intended characteristics for transparency and attenuation of signals carried by the coaxial cable to be manufactured. At S924, the overall thickness of a combined dielectric layer and the resistive layers is selected based on the determined separation. At S944, a dielectric layer with the selected thickness is formed. At S954 the resistive layers are mated to the formed dielectric layer on opposing sides. The resistive layers may be mated using an adhesive or in the same way that a single resistive layer is mounted on a dielectric substrate as in FIG. 8. At S964, a coaxial cable is assembled with the combined dielectric layer and resistive layers.

The coaxial cable assembled at S964 may be assembled using features described in the various embodiments of the preceding embodiments, wherein the combined dielectric layer and resistive layers may be used in place of any resistive layer DI/RE and second dielectric layer DI2 shown in the various embodiments. Of course, additional modifications may also be made to the previous embodiments, such as by manufacturing multiple alternating dielectric layers and resistive layers, such as two of each. In this way, a first resistive layer may replace the resistive layer DI/RE in previous embodiments and a second dielectric layer may replace the second dielectric layer DI2 of previous embodiments. A second resistive layer and a first dielectric layer of the alternating dielectric layers and resistive layers may be added features relative to the previous embodiments.

Figure 9B:
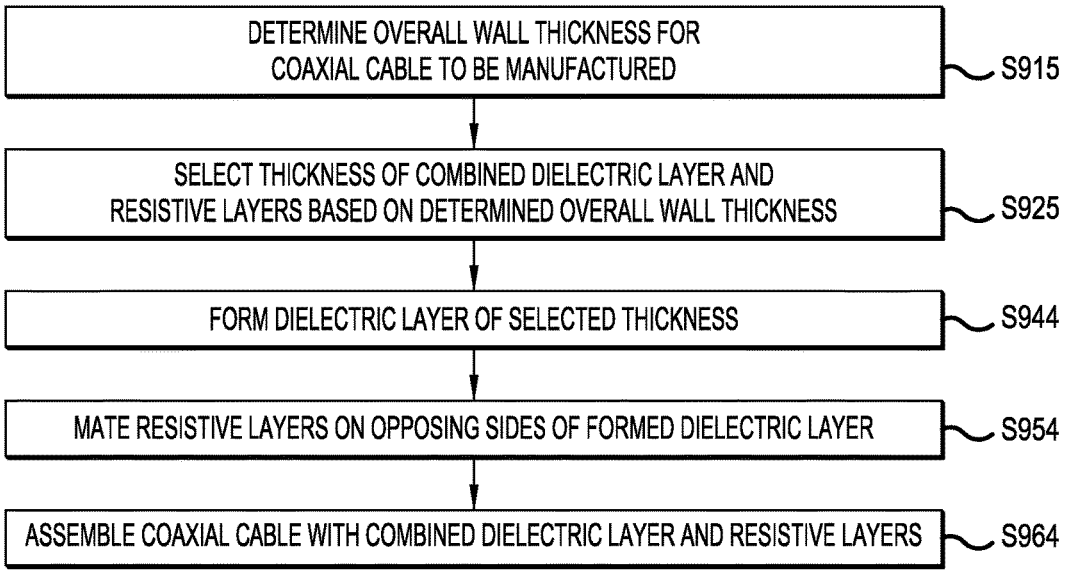
FIG. 9B illustrates another method for manufacturing the hybrid coaxial cable in accordance with a representative embodiment.

FIG. 9B illustrates another method for manufacturing the hybrid coaxial cable in accordance with a representative embodiment.

In FIG. 9B, the method starts at S915 by determining an overall wall thickness for a coaxial cable to be manufactured. The wall thickness may be a thickness of a combined dielectric layer or dielectric layers alternating with multiple resistive sheets. The wall thickness may be determined based on an intended use of the coaxial cable to be manufactured. At S915, the overall thickness of a combined dielectric layer and the resistive layers is selected based on the determined overall wall thickness. At S944, a dielectric layer with the selected thickness is formed the same as in FIG. 9A. At S954 the resistive layers are mated to the formed dielectric layer on opposing sides the same as in FIG. 9A. At S964, a coaxial cable is assembled with the combined dielectric layer and resistive layers, the same as in FIG. 9A.

Figure 9C:
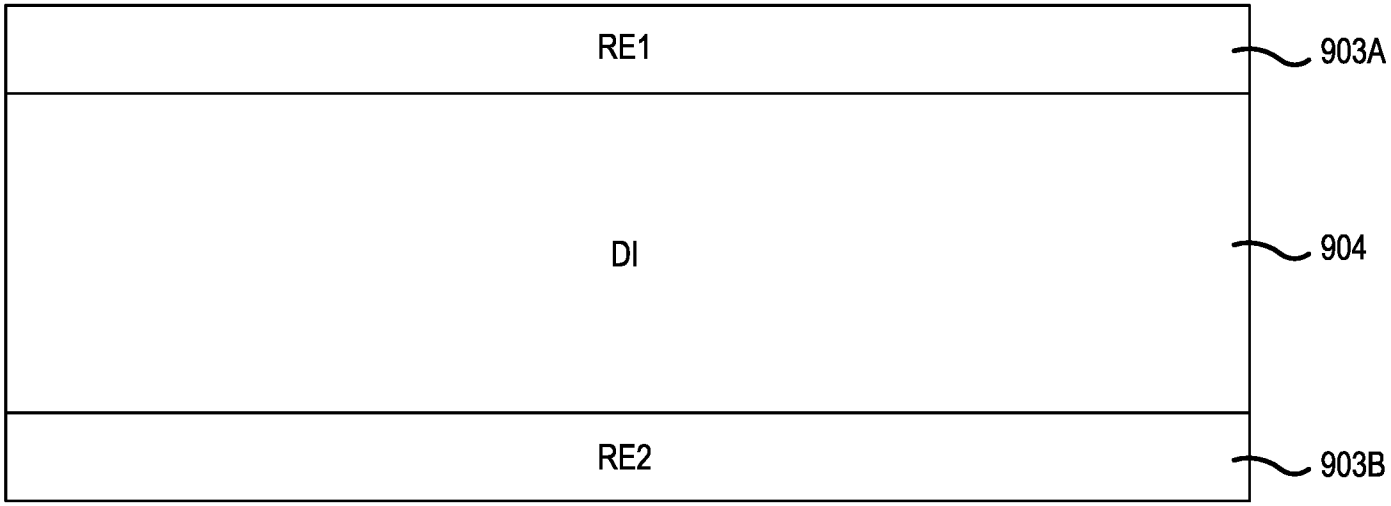
FIG. 9C illustrates a combined dielectric layer and resistive sheets selected in accordance with the methods of either FIG. 9A or 9B in accordance with a representative embodiment.

FIG. 9C illustrates a combined dielectric layer and resistive sheets selected in accordance with the methods of either FIG. 9A or 9B in accordance with a representative embodiment.

In FIG. 9C, a first resistive layer 903A is shown on one side of a dielectric 904. A second resistive layer 903B is shown on the other side of the dielectric 904. As noted above, additional dielectric layers and resistive layers may be added to form a combined "wall" of resistive layers and resistive layers. The separation between the first resistive layer 903A and the second resistive layer 903B may be determined based on a desired use for the coaxial cable to be manufactured.

Figure 10:
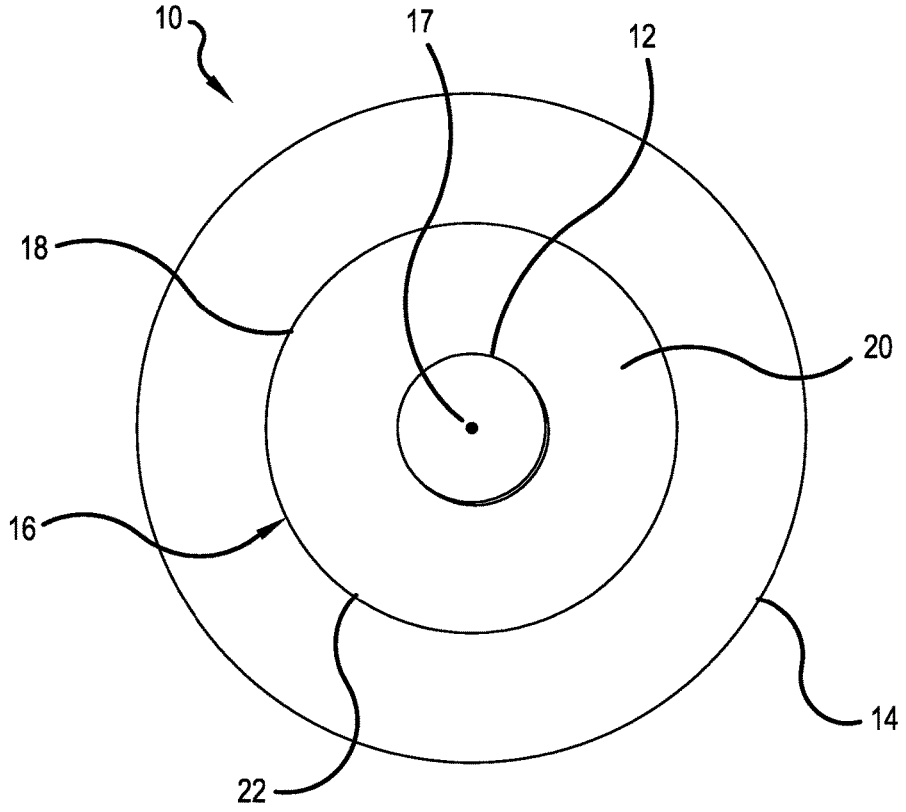
FIG. 10 illustrates a cross-sectional view of a coaxial cable manufactured in accordance with the representative embodiments.
Figure 11:
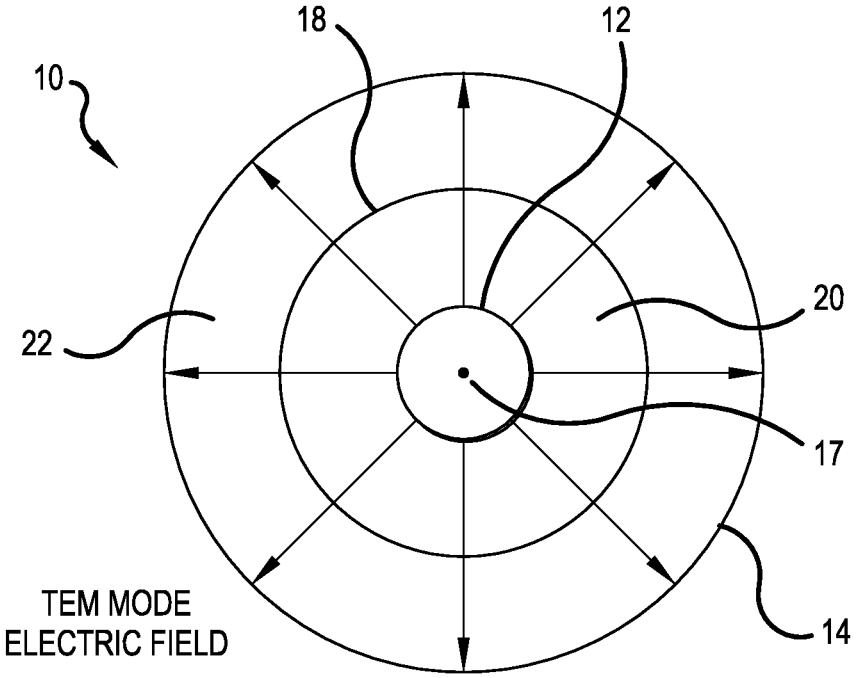
FIG. 11 illustrates a cross-sectional view of the coaxial cable of FIG. 10 and illustrates a TEM mode electric field relative to the coaxial cable.

FIG. 10 illustrates a cross-sectional view of a coaxial cable manufactured in accordance with the representative embodiments, and FIG. 11 illustrates a cross-sectional view of the coaxial cable of FIG. 10 and illustrates a TEM mode electric field relative to the coaxial cable.

In FIGS. 10-11, a coaxial cable 10 includes an inner electrical conductor 12 (sometimes referred to as a first electrical conductor), an outer electrical conductor 14 (sometimes referred to as a second electrical conductor), a dielectric region 16 between the inner electrical conductor 12 and the outer electrical conductor 14, and an electrically thin resistive layer 18 within the dielectric region 16 and concentric with the inner electrical conductor 12 and the outer electrical conductor 14. The dielectric region 16 corresponds to the various first dielectric regions and second dielectric regions described and shown in the embodiments of FIGS. 1-7B.

In representative embodiments, the electrically thin resistive layer 18 is continuous and extends along the length of the coaxial cable 10. The continuity of the electrically thin resistive layer is common to the coaxial cables of other representative embodiments described herein. Alternatively, the electrically thin resistive layer 18, as well the electrically thin resistive layer of other representative embodiments, may be discontinuous, and thereby have gaps along the length of the coaxial cable 10 and the other coaxial cables described and shown herein.

The inner electrical conductor 12 has a common propagation axis 17 with the outer electrical conductor 14. Similarly, the inner electrical conductor 12 and the outer electrical conductor 14 share a common geometric center (e.g., a point on the common propagation axis 17). Moreover, the coaxial cable 10 is substantially circular in cross-section. Generally, the term 'coaxial' means the various layers/regions of a transmission line have a common propagation axis. Likewise, the term 'concentric' means layers/regions of a coaxial cable or other transmission line have the same geometric center. As can be appreciated, the coaxial cables in some embodiments are concentric, whereas in other representative embodiments the coaxial cables are not concentric. Finally, the coaxial cables of the representative embodiments are not limited to those circular in cross-section. Rather, coaxial cables with other cross-sections are contemplated, including but not limited to, rectangular and elliptical cross-sections.

As may be appreciated by those skilled in the art, the inner electrical conductor 12 and the outer electrical conductor 14 may be any suitable electrical conductor such as a copper wire, or other metal, metal alloy, or non-metal electrical conductor. The dielectric materials or layers contemplated for use in dielectric region 16 include, but are not limited to glass fiber material, plastics such as polytetrafluoroethylene (PTFE), low-k dielectric material with a reduced loss tangent (e.g., $10^{-2}$), ceramic materials, liquid crystal polymer (LCP), or any other suitable dielectric material, including air, and combinations thereof. A protective sheath can include a protective plastic coating or other suitable protective material, and is preferably a non-conductive insulating sleeve. In representative embodiments described herein, the dielectric region 16 may comprise two more dielectric layers. Notably, the number of dielectric layers described in the various representative embodiments is generally illustrative, and two or more than two layers are contemplated. However, generally the dielectric constants of the various dielectric layers are substantially the same in order to propagate substantially TEM modes of propagation.

The coaxial cable 10 differs from other shielded cable used for carrying lower-frequency signals, such as audio signals, in that the dimensions of the coaxial cable 10 are controlled to give a substantially precise, substantially constant spacing between the inner electrical conductor 12 and the outer electrical conductor 14.

Coaxial cable 10 can be used as a transmission line for radio frequency signals. Applications of coaxial cable 10 include feedlines connecting radio transmitters and receivers with their antennas, computer network (Internet) connections, and distributing cable television signals. In radio-frequency applications, the electric and magnetic signals propagate primarily in the substantially transverse electric magnetic (TEM) mode, which is the single desired mode to be propagated by the coaxial cable. In a substantially TEM mode, the electric and magnetic fields are both substantially perpendicular to the direction of propagation. However, above a certain cutoff frequency, transverse electric (TE) or transverse magnetic (TM) modes, or both, can also propagate, as they do in a waveguide. It is usually undesirable to transmit signals above the cutoff frequency, since it may cause multiple modes with different phase velocities to propagate, interfering with each other. The average of the circumference between the inner electrical conductor 12 and the inside of the outer electrical conductor 14 is roughly inversely proportional to the cutoff frequency.

As illustrated in FIG. 11, the electrically thin resistive layer 18 is an electrically resistive layer selected and configured to be substantially transparent to a substantially transverse electric magnetic (TEM) mode of transmission, while substantially completely attenuating higher order modes of transmission. Generally, substantially completely attenuating means the coaxial cable 10, or other coaxial cables or transmission lines described herein, is designed to accommodate a predetermined threshold of relative attenuation between the desired substantially TEM mode and the undesired higher order modes. As will be appreciated, among other design consideration, this predetermined threshold is realized through the selection of the appropriate thickness (e.g., via the skin depth described below) and resistivity of the electrically thin resistive layer 18. For example, in an application where RF frequencies up to $10^2$ GHz are relevant and the transmission length is on the order of $10^1$ cm, the threshold of relative attenuation requires a TEM attenuation constant of approximately 0.1 $m^{-1}$, but attenuation of the higher order modes by more than approximately 100 $m^{-1}$, and usefully over approximately 1000 $m^{-1}$ are contemplated. On the other hand, in an application where the highest frequency of operation is only a few GHz (or less) and the transmission length is tens of meters, the threshold of relative attenuation requires a TEM attenuation constant of approximately 0 $m^{-1}$ to approximately 0.01 $m^{-1}$, while attenuating the higher order modes by at least approximately 1.0 $m^{-1}$, but usefully by more than approximately 10 $m^{-1}$ are contemplated. It is emphasized that these examples are merely illustrative, and are not intended to be limiting of the present teachings.

As used herein, an "electrically thin" layer is one for which the layer thickness is less than the skin depth δ at the (highest) signal frequency of interest. This insures that the substantially TEM mode is minimally absorbed. The skin depth is given by $\delta=1/\sqrt{(\pi f \mu \sigma)}$, where δ is in meters, f is the frequency in Hz, μ is the magnetic permeability of the layer in Henrys/meter, and σ is the conductivity of the layer in Siemens/meter.

For the discussions herein, if t is the physical thickness of the electrically thin resistive layer 18, it is "electrically thin" if $t<\delta_{min}=1/\sqrt{(\pi f_{max}\mu\sigma)}$, where $\delta_{min}$ is the skin depth calculated at the maximum frequency $f_{max}$. For example, suppose $f_{max}$=200 GHz, the layer is nonmagnetic and hence $\mu=\mu_0$=the vacuum permeability=4π*10-7 Henrys/meter, and the conductivity is 100 Siemens/meter. Then $\delta_{min}$=112.5 μm, so a resistive layer thickness t of 25 μm would be considered electrically thin in this case. Recapitulating, the electrically thin resistive layer 18 is electrically thin when its thickness is less than a skin depth at a maximum operating frequency of the coaxial cable 10.

The dielectric region 16 may comprise an inner dielectric material 20 between the inner electrical conductor 12 and the electrically thin resistive layer 18, and an outer dielectric material 22 between the electrically thin resistive layer 18 and the outer electrical conductor 14. In various embodiments, the inner dielectric material 20 and the outer dielectric material 22 have approximately the same thickness. In some embodiments, a thickness of the inner dielectric material 20 is approximately twice a thickness of the outer dielectric material 22.

The electrically thin resistive layer 18 may be an electrically thin resistive coating on the inner dielectric material 20. The electrically thin resistive layer 18 illustratively includes at least one of TaN, WSiN, resistively-loaded polyimide, graphite, graphene, transition metal dichalcogenide (TMDC), nichrome (NiCr), nickel phosphorus (NiP), indium oxide, and tin oxide. Notably, however, other materials within the purview of one of ordinary skill in the art having the benefit of the present teachings, are contemplated for use as the electrically thin resistive layer 18.

Transition metal dichalcogenides (TMDCs) include: $HfSe_2$, $HfS_2$, $SnS_2$, $ZrS_2$, $MoS_2$, $MoSe_2$, $MoTe_2$, $WS_2$, $WSe_2$, $WTe_2$, $ReS_2$, $ReSe_2$, $SnSe_2$, $SnTe_2$, $TaS_2$, $TaSe_2$, MoSSe, WSSe, $MoWS_2$, $MoWSe_2$, $PbSnS_2$. The chalcogen family includes the Group VI elements S, Se and Te.

The electrically thin resistive layer 18 may have an electrical sheet resistance between 20-2500 ohms/sq and preferably between 20-200 ohms/sq.

Figure 12:
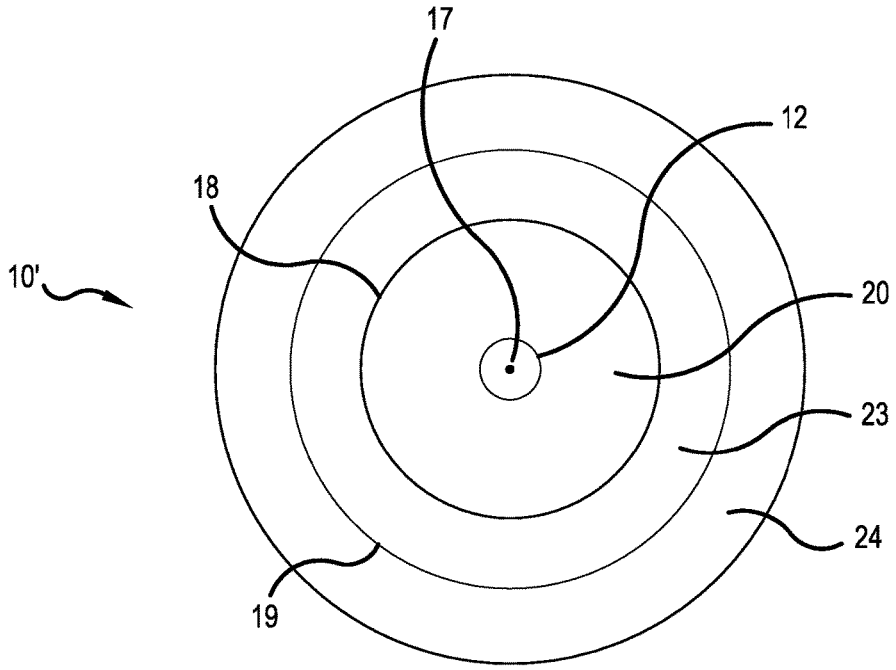
FIG. 12 illustrates a cross-sectional view of another coaxial cable manufactured in accordance with the representative embodiments.

FIG. 12 illustrates a cross-sectional view of another coaxial cable manufactured in accordance with the representative embodiments.

In FIG. 12, another embodiment of a coaxial cable 10' includes an additional electrically thin resistive layer 19 within the dielectric region and concentric with the inner electrical conductor 12 and the outer electrical conductor 14. In such an embodiment, the dielectric region includes the inner dielectric material 20, a middle dielectric material 23, and an outer dielectric material 24. Such dielectric materials may include the same or different materials. Multiple electrically thin resistive layers may be included based upon desired attenuation characteristics. In the embodiment of FIG. 12, the processes described with respect to FIGS. 1-7B can be modified to duplicate the processes for handling the dielectric/resistive layers (or parallel layers in other embodiments) and the second dielectric layers 104 (and parallel layers in other embodiments), so as to provide the additional electrically thin resistive layer 19 and the outer dielectric material 24 that is a third dielectric layer.

Adding a second electrically thin resistive layer, perhaps ⅔ of the way in from the outer electrical conductor 14 may be better positioned to attenuate some higher order modes, and may be beneficial in the presence of multiple discontinuities or with a poorly matched load. It may also be useful to allow a cable to be bent multiple times. So, it may be desired to include the additional electrically thin resistive layer 19 between electrically thin resistive layer 18 and the outer electrical conductor 14. However, the benefits of the additional electrically thin resistive layer 19 must be weighed against the possible disadvantage that the additional electrically thin resistive layer 19 may add some insertion loss for the dominant substantially TEM mode.

Having set forth the various structures of the exemplary embodiments above, features, advantages and analysis will now be discussed. The example embodiments are directed to a coaxial cable 10, 10', e.g. a coaxial cable 30, in which an electrically thin resistive layer 18 that is concentric and that is sandwiched somewhere within the dielectric region 16 that is insulating and that separates the inner electrical conductor 12 and outer electrical conductor 14. Namely, in addition to the typical inner and outer electrical conductors 12/14 made out of metals with high conductivity, an inner dielectric and an outer dielectric are separated by an electrically thin resistive layer 18 that is cylindrical in this case. All regions, inner electrical conductor 12, inner dielectric material 20, electrically thin resistive layer 18 that is cylindrical, outer dielectric material 22, and outer electrical conductor 14 are concentric. The term coaxial and/or concentric means that the layers/regions have the same axis/center. This is not limited to any particular cross-section. Circular, rectangular and other cross sections are contemplated herein. By way of example, the inner and outer conductors may have other cross-sectional shapes, such as rectangular. Alternatively, the inner and outer conductors may have different cross-sectional shapes (e.g., the inner conductor may be circular in cross-section, and the outer conductor may be rectangular in cross-section). Regardless of the shapes of the inner and outer conductors, the electrically thin resistive layer is selected to have a shape so that the electric field lines of the substantially TEM mode are substantially perpendicular (i.e., substantially parallel to the normal of the electrically thin resistive layer) at each point of incidence, and to be substantially transparent to the substantially TEM mode of transmission, while substantially attenuating higher order modes of transmission.

As in conventional coaxial cables, the desired substantially transverse electric magnetic (TEM) features an everywhere substantially radially directed electric field, as shown in FIG. 11. All higher order modes, whether transverse electric (TE) or transverse magnetic (TM), fail to have this property.

In particular, all TM modes have a strong longitudinal (along the axis) component of electric field. These longitudinal electric vectors will generate axial RF currents in the resistive cylinder, leading to high ohmic dissipation of the TM modes. Conversely, the TE modes have pronounced azimuthal (i.e., clockwise or counterclockwise directed about the axis) electric field vectors, which in turn generate local azimuthal currents in the resistive cylinder. Again, since an electrically thin resistive sheet is not a good electrical conductor, high ohmic dissipation of the TE modes beneficially results.

The substantially TEM mode, on the other hand, suffers little ohmic dissipation because the thin resistive cylinder does not allow radial currents to flow.

An important advantage of the embodiments of the present teachings is the realization of comparatively larger dimensions for both the inner and outer electrical conductors to be used at higher frequencies. This results in less electrically conductive loss for the desired broadband substantially TEM mode due to reduced current crowding. It also allows the potential use of sturdier connectors and a sturdier cable itself to a given maximum TEM frequency. As opposed to waveguide technology, the present embodiments are still a truly broadband (DC to a very high frequency, e.g. millimeter waves or sub-millimeter waves) conduit.

In practice, the industry likes to deal with 50-ohm cables at millimeter-wave frequencies. The usual dielectric PTFE has a relative dielectric constant of approximately 1.9—the exact value depends on the type of PTFE and the frequency, but this is close enough for this discussion. For this dielectric value in a conventional coaxial cable, the ratio of outer electrical conductor to inner electrical conductor=3.154 to achieve 50Ω characteristic impedance.

An example of a practical frequency extension goal is now discussed. 1.85-mm cable is single-mode up to approximately ~73 GHz. It would be very useful to extend this frequency almost threefold to 220 GHz, for example. A relevant computation is to identify how many and which TE and TM modes between 73 GHz and 220 GHz have to be attenuated by the resistive cylindrical sheet.

A simple way to do this accounting is to compute the dimensionless eigenvalues $k_c a$ for the higher-order modes, where $k_c$ is the cutoff wavenumber=$2\pi/\lambda_c$ and 2a is the outer electrical conductor ID. Here $\lambda_c$ is the free-space cutoff wavelength=$c/f_c$, where $f_c$ is the cutoff frequency and c is the speed of light in vacuum. The lowest eigenvalue corresponds to the ~73 GHz cutoff of the first higher-order mode, which happens to be the TE11 mode. Any eigenvalue within a factor of 3 of the lowest eigenvalue indicates a mode that should be attenuated. Eigenvalues more than a factor of 3 greater than the lowest eigenvalue correspond to modes that are still in cutoff, even at 220 GHz.

The reason for using dimensionless eigenvalues is that the same reasoning can be scaled to other cases. For example, it may be desired to extend the operating frequency of 1-mm cable, which is single-mode to ~120 GHz, to ~360 GHz. The lowest eigenvalue then corresponds to the ~120 GHz cutoff of the $TE_{11}$ mode in 1-mm cable.

Let r be the radius of the resistive cylinder. To keep the discussion generic (as opposed to dealing only with 1.85-mm cable), the designer can hone the sheet resistance and the dimensionless ratio a/r, where 2a is the inner diameter ID of the outer electrical conductor. Sheet resistance in the range of approximately 20 Ω/sq to approximately 200 Ω/sq and a/r values in the range approximately 1.2 to approximately 2.4 are effective. The resistive cylinder may be substantially midway between the inner electrical conductor and the outer electrical conductor.

A variation of the embodiments of the present teachings is to provide the electrically thin resistive layer only in the "perturbed" lengths of the coaxial cable. That is, in the truly straight sections of a coaxial reach, all the modes are orthogonal so they don't couple to each other. It is only where the ideal coax is perturbed, e.g., at connectors and in bends, that the modes are deformed from their textbook distributions and cross-coupling can occur. Therefore, another strategy is to include the electrically thin resistive layer only in/near the connectors and in pre-bent regions and to advise the cable user to avoid bending prescribed straight sections that may omit the electrically thin resistive layer. This approach has the advantage of reducing or minimizing attenuation of the substantially TEM mode which may be especially important for long cables or at very high frequencies where the skin depth of the substantially TEM mode approaches the thickness of the resistive sheet.

Although not detailed for embodiments above, electrical connectors that terminate or interconnect coaxial cables will also have many aspects and details of the coaxial lines manufactured in accordance with the embodiments described herein. Electrical connectors include coaxial electrical connectors, for example, though other electrical connectors are contemplated by the present teachings. Electrical connectors can be male-to-female, male-to-male or female-to-female, and can include inner electrical conductors, outer electrical conductors, dielectric regions between the inner electrical conductors and the outer electrical conductors, and an electrically thin resistive layer that are manufactured to match those of the coaxial cables described herein. Additionally, the electrically thin resistive layers of electrical connectors can be continuous, or may be discontinuous with gaps along the length of the electrical connectors.

In certain embodiments, the dielectric material described herein may be air, while in other embodiments in order to ensure separation of the inner electrical conductor, electrically thin resistive layer, and outer electrical conductor, dielectric beads may be used in one or more dielectric layers disposed between the inner electrical conductor, and outer electrical conductor. Such dielectric beads may be formed of a known material suitable such as a dielectric material described herein.

As described above, hybrid coaxial cable fabrication provides mode-less operation far beyond traditional semi-rigid cable construction by providing a centered resistive layer using a multi-layered construction. Hybrid coaxial cable fabrication described herein can be processed in both reel-to-reel as well as in discrete lengths which lend themselves to hybrid multilayered construction with a centered resistive layer. Low capital cost is made possible, and this can be useful for semi-rigid hybrid coaxial cables with discrete length design. Because hybrid coaxial cable fabrication can utilize discrete lengths it is possible to tailor processing and preparation methods to creating optimal geometries that minimize burrs and material non-conformities in the connector region of the design. A variety of the mechanisms taught herein, including the use of extrusion, heat shrinking, and other forms of stretching the resistive sheets used herein during manufacture, will minimize the resultant burrs. Moreover, hybrid coaxial cable fabrication is adaptable to flex cable by the use of a stranded center conductor and helically wrapped or braided outer conductors, and these may also provide tension that helps minimize burrs in material layers.

Additionally, several embodiments describe different mechanisms to avoid overlapping gaps between different layers. This is consistently described by providing gaps and/or slit-cuts in different layers at different angles around the axis, including uniform angles. Thus, gaps and/or slit-cuts are not superimposed from one layer to the next, and are not cumulative. Similarly, helical wrapping may involve offsetting starting points and wrapping angles so that each layer of helical wrapping minimizes or eliminates gaps in lower/underlying layers of the helical wrapping. Additionally, the uniform spacing of gaps between layers or even in one layer may be performed to achieve substantially uniform density around the axis. Finally, as described with respect to various embodiments herein, gaps in lower layers may be affirmatively reduced or even eliminated in the process of adding outer layers by, for example, slip-fitting an added outer layer, or otherwise by drawing, helical wrapping, or braiding an outer layer (e.g., the outer conductor) over a sub-assembly.

The coaxial cables manufactured in accordance with the embodiments described herein may be used to transmit signals in the radio frequency (RF) spectrum and higher frequencies. The coaxial cables may be configured for use in RF, microwave and millimeter wave applications. Applications of such coaxial cables include routing high frequency signals in an electronic test and measurement instrument, and connecting between an electronic test and measurement instrument and a DUT (device under test), connecting radio transmitters and receivers with their antennas, computer network (Internet) connections, and distributing cable television signals. In radio-frequency applications, the electric and magnetic signals propagate primarily in the substantially transverse electric magnetic (TEM) mode, which is the single desired mode to be propagated by the electrical connector 1300 and transmission lines connected thereto. In a substantially TEM mode, the electric and magnetic fields are both substantially perpendicular to the direction of propagation. However, above a certain cutoff frequency, transverse electric (TE) or transverse magnetic (TM) modes, or both, can also propagate, as they do in a waveguide. It is usually undesirable to transmit signals above the cutoff frequency, since it may cause multiple modes with different phase velocities to propagate, interfering with each other. The average of the circumference between the inner electrical conductor 1312 and the inside of the outer electrical conductor 1314 is roughly inversely proportional to the cutoff frequency.

Figure 13A:
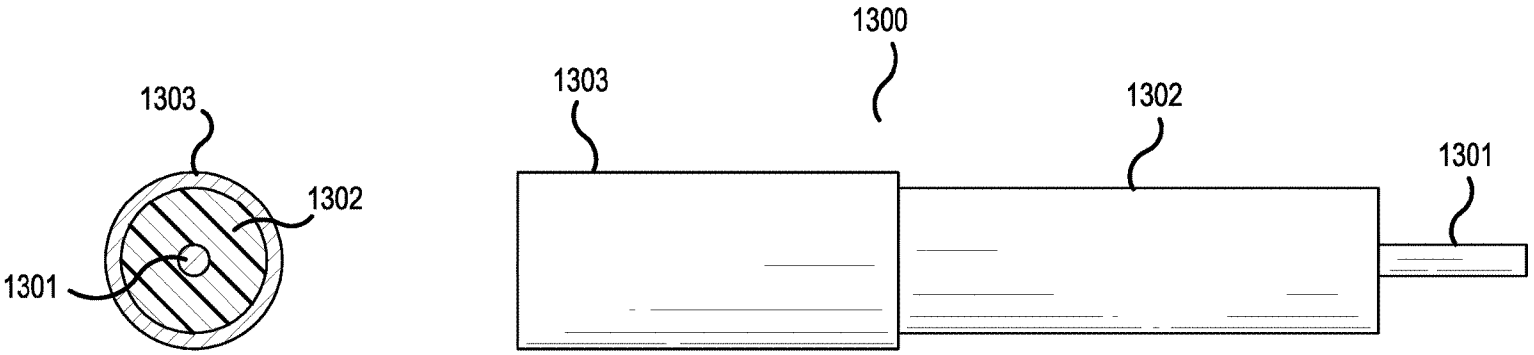
FIG. 13A depicts a perspective view and a cross-sectional view of a coaxial cable.

FIG. 13A depicts a perspective view and a cross-sectional view of a coaxial cable 1300. The coaxial cable 1300 comprises an inner conductor 1301, a dielectric layer 1302 disposed around the inner conductor 1301, and an outer conductor 1303 disposed around the dielectric layer 1302.

Figure 13B:
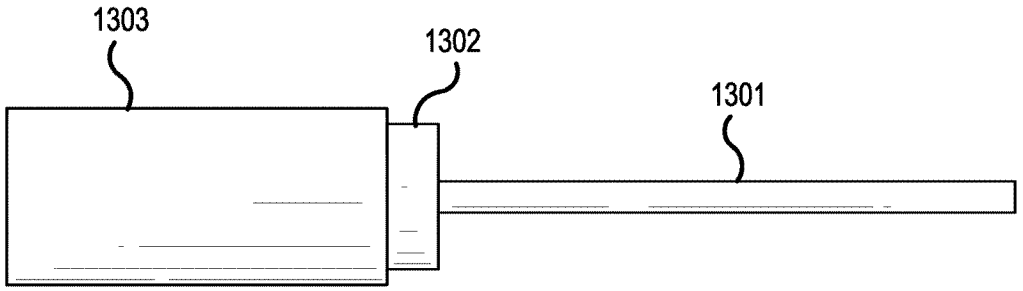
FIG. 13B depicts a perspective view of the coaxial cable of FIG. 13A during a method in accordance with a representative embodiment.

FIG. 13B depicts a perspective view of the coaxial cable 1300 of FIG. 13A during a method in accordance with a representative embodiment. Notably, for reasons described more fully below, the dielectric layer 1302 is partially removed leaving the inner conductor 1301 exposed over a length.

Figure 14A:
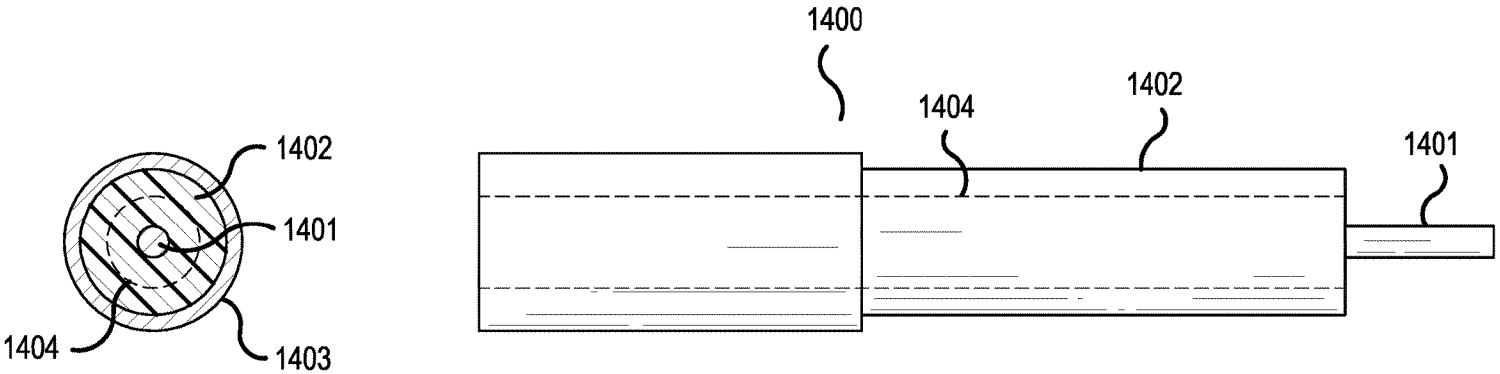
FIG. 14A depicts a perspective view and a cross-sectional view of a coaxial cable in accordance with a representative embodiment.

FIG. 14A depicts a perspective view and a cross-sectional view of a coaxial cable 1400 in accordance with a representative embodiment. The coaxial cable 1400 comprises an inner conductor 1401, a dielectric layer 1402 disposed around the inner conductor 1401, and an outer conductor 1403 disposed around the dielectric layer 1402. The coaxial cable 1400 also comprises an electrically thin resistive layer 1404 disposed in the dielectric layer 1402, and between the inner conductor 1401 and the outer conductor 1403. The electrically thin resistive layer 1404 is contemplated to be as described in the above-incorporated patent applications, and further description thereof in connection with the present described representative embodiment.

Figure 14B:
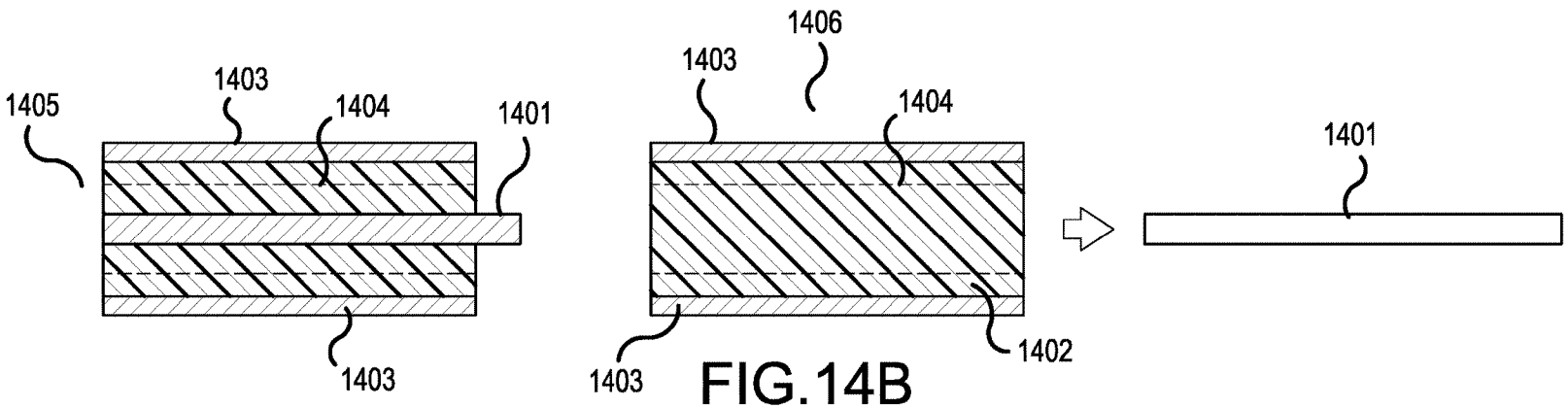
FIG. 14B depicts a cross-sectional view of the coaxial cable of FIG. 14A during a method in accordance with a representative embodiment.

FIG. 14B depicts a cross-sectional view of the coaxial cable of FIG. 14A during a method in accordance with a representative embodiment. As depicted in FIG. 14B, a section of resistive coaxial cable 1405 of the coaxial cable 1400 has been prepared by selectively cutting a portion of the coaxial cable 1400. Next, the inner conductor 1401 is removed from the section of resistive coaxial cable 1405 to provide the section of resistive cable 1406.

FIGS. 15A-15D depict in perspective views and cross-sectional views a method of providing a section of resistive cable between a coaxial cable and a coaxial electrical connector in accordance with a representative embodiment.

Figure 15A:
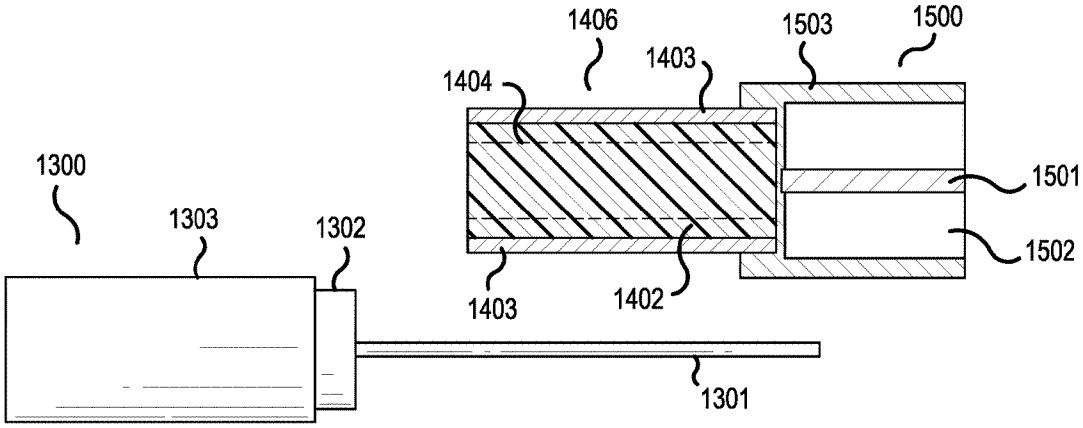
FIGS. 15A-15D depict in perspective views and cross-sectional views of a method of providing a section of resistive cable between a coaxial cable and a coaxial electrical connector in accordance with a representative embodiment.

Turning first to FIG. 15A, a coaxial electrical connector 1500 is disposed at a first end of the section of resistive cable 1406 as shown. The coaxial electrical connector 1500 comprises an inner conductor 1501, a dielectric region 1502, and an outer conductor 1503. Notably, the dielectric region may be filled with air.

FIG. 15A also depicts the coaxial cable 1300 of FIG. 13B with the dielectric layer 1302 partially removed leaving the inner conductor 1301 exposed over a length. As will become clearer as the present description continues, the coaxial cable, the section of resistive cable 1406, and the coaxial electrical connector 1500 combine to provide a signal transmission line in accordance with a representative embodiment.

Figure 15B:
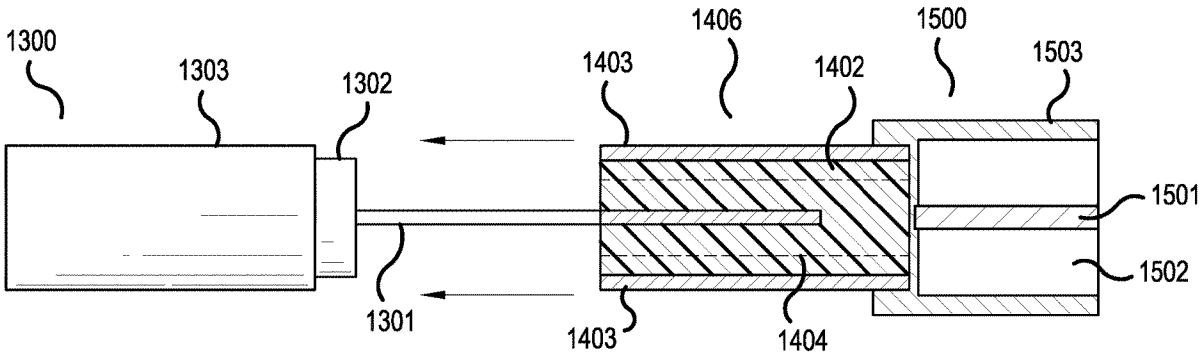

FIG. 15B shows the outer conductor 1503 disposed over a portion of the outer conductor 1403 at the first end of the section of resistive cable 406 to ensure continuity of the ground plane of a signal transmission line described more fully below. The outer conductors 1403, 103 are electrically connected to one another by a suitable conductive adhesive such as solder or conductive epoxy.

Figure 15C:
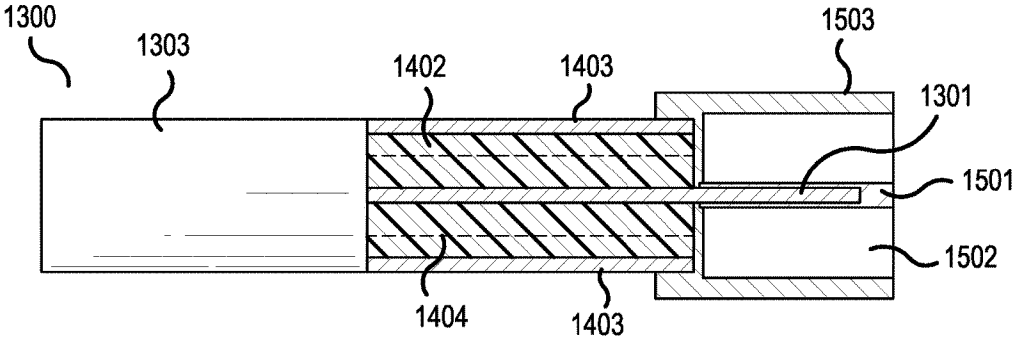
Figure 15D:
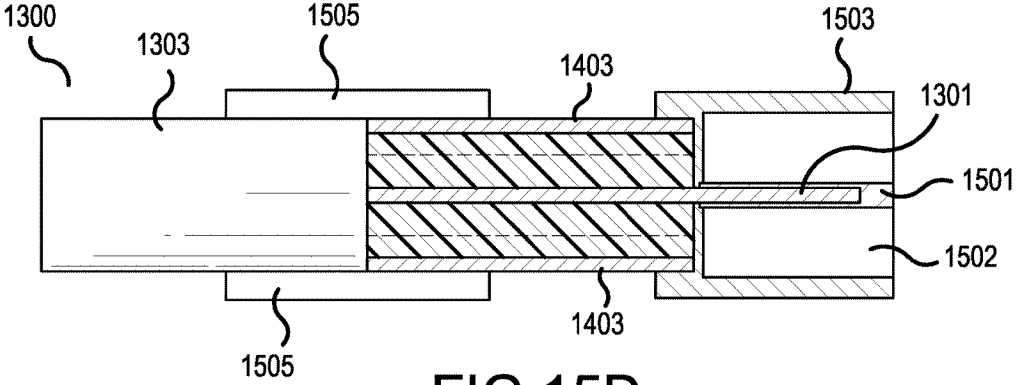

FIG. 15C shows the inner conductor 1301 of the coaxial cable 1300 disposed through the dielectric layer 1402, with the electrically thin resistive layer 1404 disposed around the inner through the dielectric layer 1402 so that the electrically thin resistive layer 1404 is disposed between the inner conductor 1301 and the outer conductor 1403 of the section of resistive cable 1406. As shown in this embodiment, the inner conductor 1301 is inserted into the inner conductor 1501 of the coaxial electrical connector 1600, wherein the inner conductor 1501 is thus hollow to a degree that the inner conductor 1301 can be inserted therein. With the inner conductor 1301 in place, a conductive adhesive (not shown) such as solder or conductive epoxy is used to fasten the inner conductor 1301 to the inner conductor 1501 of the electrical coaxial connector 1600.

Turning to FIG. 5D, a sleeve 1505, which is illustratively metal, is disposed over the outer conductor 1303, and the outer conductor 1403 to ensure greater stability at the junction of the section of the resistive coaxial cable, and the coaxial cable 1300. The sleeve 1505 may be adhered by a suitable adhesive, such as solder, conductive epoxy, or epoxy.

Figure 16A:
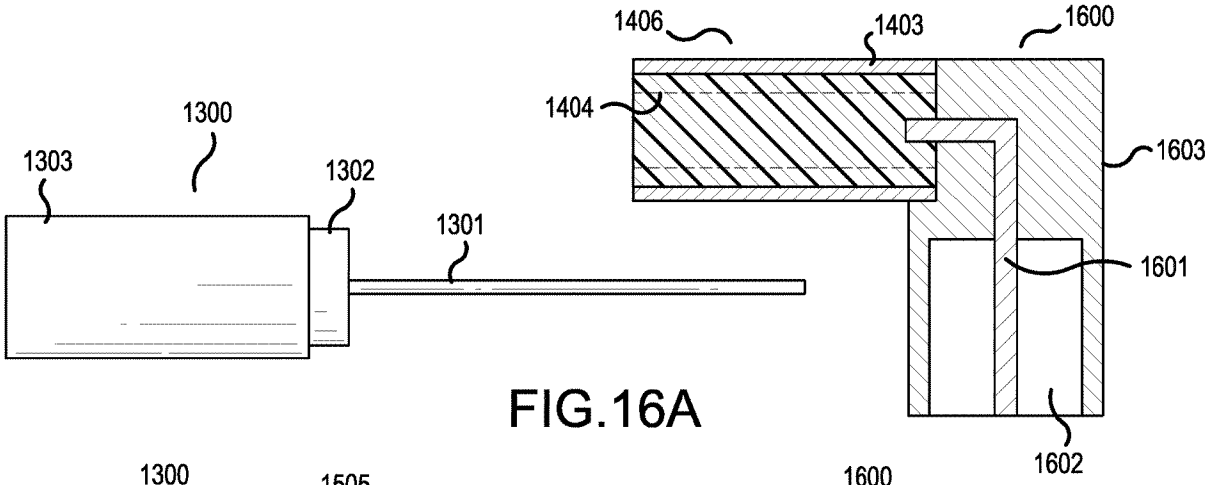
FIGS. 16A-16B depict in perspective views and cross-sectional views of a method of providing a section of resistive cable between a coaxial cable and a coaxial electrical connector in accordance with a representative embodiment.
Figure 16B:
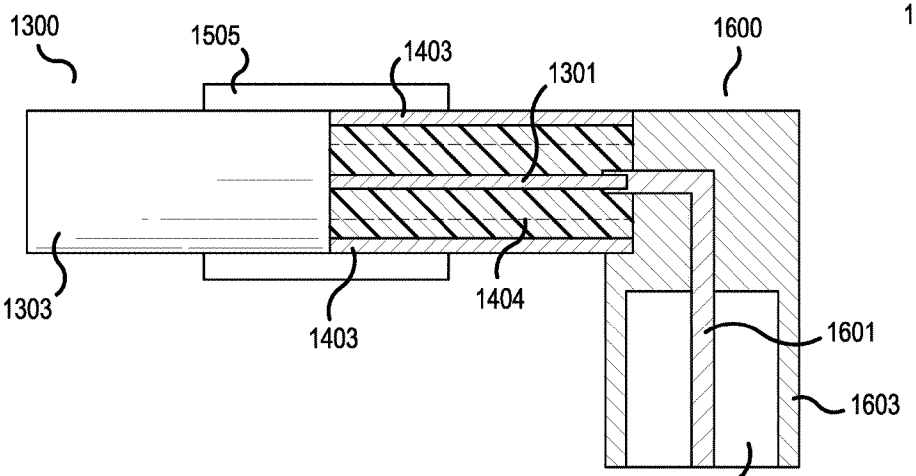

FIGS. 16A-16B depict in perspective views and cross-sectional views a method of providing a section of resistive cable between a coaxial cable and a right-angle coaxial electrical connector in accordance with a representative embodiment.

Turning first to FIG. 16A, a right angle coaxial electrical connector 1600 is disposed at a first end of the section of resistive cable 1406 as shown. The coaxial electrical connector 1500 comprises an inner conductor 1501, a dielectric region 1502, and an outer conductor 1503. Notably, the dielectric region may be filled with air.

FIG. 16A also depicts the coaxial cable 1300 of FIG. 13B with the dielectric layer 1302 partially removed leaving the inner conductor 1301 exposed over a length. As will become clearer as the present description continues, the coaxial cable 1300, the section of resistive cable 1406, and the coaxial electrical connector 1500 combine to provide a signal transmission line in accordance with a representative embodiment.

As shown, the outer conductor 1503 is disposed over a portion of the outer conductor 1403 at the first end of the section of resistive cable 406 to ensure continuity of the ground plane of a signal transmission line described more fully below. The outer conductors 1403, 1503 are electrically connected to one another by a suitable conductive adhesive such as solder or conductive epoxy.

Turning to FIG. 16B, the inner conductor 1301 of the coaxial cable 1300 is shown as being disposed through the dielectric layer 1402, with the electrically thin resistive layer 1404 disposed around the inner through the dielectric layer 1402 so that the electrically thin resistive layer 1404 is disposed between the inner conductor 1301 and the outer conductor 1403 of the section of resistive cable 1406 is depicted. As shown in this embodiment, the inner conductor 1301 is inserted into the inner conductor 1601 of the coaxial electrical connector 1600, wherein the inner conductor 1601 is thus hollow to a degree that the inner conductor 1301 can be inserted therein. With the inner conductor 1301 in place, a conductive adhesive (not shown) such as solder or conductive epoxy is used to fasten the inner conductor 1301 to the inner conductor 1501 of the electrical coaxial connector 1600. Finally, the sleeve 1505, which is illustratively metal, is disposed over the outer conductor 1303, and the outer conductor 1403 to ensure greater stability at the junction of the section of the resistive coaxial cable, and the coaxial cable 1300. The sleeve 1605 may be adhered by a suitably adhesive, such as solder, conductive epoxy, or epoxy.

Figure 17:
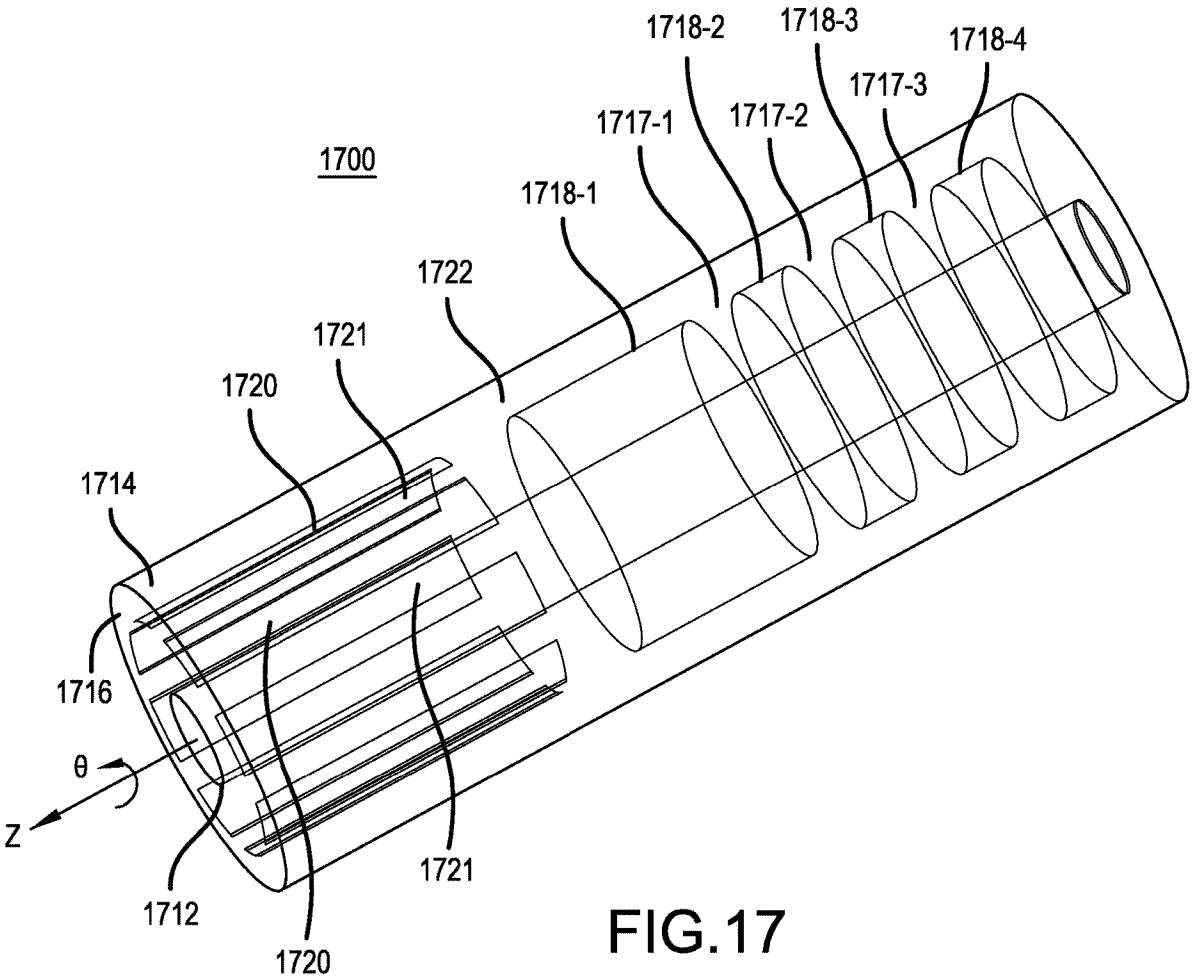
FIG. 17 is a perspective view of a coaxial transmission line in accordance with a representative embodiment.

FIG. 17 is a perspective view of a coaxial transmission line 1700 in accordance with a representative embodiment. The coaxial transmission line 1700 may be processed as described above in connection with the representative embodiments of FIGS. 14A-16B to provide a section of resistive cable.

The coaxial transmission line 1700 of FIG. 17 is useful in illustrating a discontinuous electrically thin resistive layer in accordance with representative embodiments, with sections of the electrically thin resistive layer, and of the gaps therebetween, having the same or differing lengths. As will be appreciated as the present description continues, the variety of configurations of the electrically thin resistive layer is useful in addressing challenges of improving TEM insertion loss, while attenuating higher order modes.

The coaxial transmission line 1700 comprises an inner electrical conductor 1712 (sometimes referred to as a first electrical conductor), an outer electrical conductor 1714 (sometimes referred to as a second electrical conductor), a dielectric region 1716 between the inner electrical conductor 1712 and the outer electrical conductor 1714, and first through fourth sections 1718-1~1718-4 of an electrically thin resistive layer within the dielectric region 1716 and concentric with the inner electrical conductor 1712 and the outer electrical conductor 1714. As such, in certain representative embodiments, the electrically thin resistive layer is not continuous, but rather has gaps along the length of the coaxial transmission line 1700. In the illustrative configuration of FIG. 17, there are first through third gaps 1717-1~1717-3 between respective first through fourth sections 1718-1~1718-4 of the electrically thin resistive layer. As depicted in FIG. 17, the first through third gaps 1717-1~1717-3 are disposed along a perimeter of respective ones of the first through fourth sections 1718-1~1718-4. As such, first through third gaps 1717-1~1717-3 exist perimetrically in the electrically thin resistive layer. Alternatively, the configuration of the first through third gaps 1717-1~1717-3 can be referred to as being disposed longitudinally along a length of the electrically thin resistive layer, where, as described below, the length is in the z-direction according to the coordinate system of FIG. 17.

The coaxial transmission line also comprises sections 1720 of the electrically thin resistive layer, each spaced from the next by a respective one of a plurality of gaps 1721. Notably, the number of sections and the number of gaps depicted in FIG. 17 is merely illustrative, and more or fewer sections and gaps are contemplated. (Notably, only two sections 1720 and two gaps are delineated in FIG. 17 to avoid obscuring the present description.)

As depicted in FIG. 17, the gaps 1721 exist around the perimeter (i.e., perimetrically) in the electrically thin resistive layer. To this end, rotation around Θ depicted in FIG. 17, alternating gaps 1721 and sections 1720 are traversed. As noted above, like the longitudinal gaps (first through third gaps 1717-1~1717-3), the alternating gaps 1721 reduce the overall area of the electrically resistive layer of which sections 1720 are comprised. As such, it is possible to attenuate power of higher order modes, while reducing attendant attenuation of the desired TEM mode.

As shown in FIG. 17, each of the first through fourth sections 1718-1~1718-4 of the electrically thin resistive layer, and each of the first through third gaps 1717-1~1717-3 have a length along the z direction of the coordinate system depicted in FIG. 17. As depicted, the first through fourth sections 1718-1~1718-4 may have substantially the same length (e.g., third and fourth sections 1718-3 and 1718-4), or may have different lengths (e.g., first section 1718-1 and fourth section 1718-4). Similarly, the first through third gaps 1717-1~1717-3 may have the same length (e.g., first and second gaps 1717-1 and 1717-2), or may have different lengths.

Similarly, the widths (measured by rotation around z by Θ) of the sections 1720 may be the same, or the sections 1720 may have differing widths, or a combination thereof. Similarly, the lengths (z-direction of the coordinate system depicted in FIG. 17) of the sections 1720 may be the same, or the sections 1720 may have differing widths, or a combination thereof.

As will be described in accordance with representative embodiments, and as can be empirically determined based on the present teachings, and among other benefits, the ability to tailor the widths of the sections 1720, and the widths of the 1721 enables the fabrication of coaxial transmission lines that address various common situations experienced in the use of such transmission lines.

In various embodiments, the dielectric region may include an inner dielectric material between the inner electrical conductor and the electrically thin resistive layer, and an outer dielectric material between the electrically thin resistive layer and the outer electrical conductor. The inner dielectric material and outer dielectric material may have approximately the same thickness, or a thickness of the inner dielectric material may be approximately twice a thickness of the outer dielectric material.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

While hybrid coaxial cable fabrication has been illustrated and described in detail in the drawings and foregoing description, such illustration and description are to be considered illustrative or exemplary and not restrictive; hybrid coaxial cable fabrication is not limited to the disclosed embodiments.

Other variations to the disclosed embodiments can be understood and effected by those skilled in the art in practicing the claimed invention(s), from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to an advantage.

While representative embodiments are disclosed herein, one of ordinary skill in the art appreciates that many variations that are in accordance with the present teachings are possible and remain within the scope of the appended claim set. Hybrid coaxial cable fabrication therefore is not to be restricted except within the scope of the appended claims.

The invention claimed is:

1. A signal transmission line, comprising:

a coaxial electrical connector comprising a coaxial electrical connector inner conductor and a coaxial outer conductor;

a coaxial cable comprising a coaxial inner conductor and a coaxial outer conductor; and a section of resistive cable disposed between the coaxial cable and the coaxial electrical connector, the section of resistive cable comprising an electrically thin resistive layer disposed between the coaxial cable inner conductor and a section outer conductor, wherein a gap exists in the electrically thin resistive layer, and the coaxial cable inner conductor is fastened to the coaxial electrical connector inner conductor.

2. The signal transmission line as claimed in claim 1, wherein the coaxial cable inner conductor is disposed in the section of resistive cable.

3. The signal transmission line as claimed in claim 1, wherein the electrically thin resistive layer is substantially transparent to an electric field of a substantially transverse-electromagnetic (TEM) mode of transmission while substantially attenuating higher order modes of transmission.

4. The signal transmission line of claim 2, wherein an electric field exists between the coaxial inner conductor disposed in the section outer conductor, the electric field having electric field lines that are perpendicular to the electrically thin resistive layer at each point of contact with the electrically thin resistive layer.

5. The signal transmission line of claim 2, wherein the coaxial cable inner conductor disposed in the section of resistive cable is substantially surrounded by the section outer conductor, and is substantially located at a geometric center of the section outer conductor.

6. The signal transmission line of claim 2, wherein the section of resistive cable comprises a dielectric region, comprising:

a first dielectric layer disposed between the inner section conductor and the electrically thin resistive layer; and a second dielectric layer between the electrically thin resistive layer and the section outer conductor.

7. The signal transmission line of claim 1, wherein the gap are perimetrically spaced in the electrically thin resistive layer.

8. The signal transmission line of claim 1, wherein the gap exists radially in the electrically thin resistive layer.

9. The signal transmission line of claim 1, wherein a plurality of gaps exist in the electrically thin resistive layer, and some of the plurality of gaps exist perimetrically in the electrically thin resistive layer.

10. The signal transmission line of claim 9, wherein some of the plurality of gaps exist radially in the electrically thin resistive layer.

11. A signal transmission line, comprising:

a coaxial electrical connector comprising a coaxial electrical connector inner conductor; and a section of resistive cable comprising a first end and a second end, the section of resistive cable being adapted to connect to the coaxial electrical connector on the second end, wherein the section of resistive cable comprises an electrically thin resistive layer disposed between an inner region of the section of resistive cable and a section outer conductor, and a gap exists in the electrically thin resistive layer.

12. The signal transmission line of claim 11, wherein the section of resistive cable is configured to receive an inner conductor of a coaxial cable disposed at the second end.

13. The signal transmission line as claimed in claim 11, wherein the electrically thin resistive layer is substantially transparent to a substantially transverse-electromagnetic (TEM) mode of transmission while substantially attenuating higher order modes of transmission.

14. The signal transmission line of claim 11, wherein the gap exists perimetrically in the electrically thin resistive layer.

15. The signal transmission line of claim 11, wherein the gap exists radially in the electrically thin resistive layer.

16. The signal transmission line of claim 11, wherein a plurality of gaps exist in the electrically thin resistive layer, and some of the plurality of gaps exist perimetrically in the electrically thin resistive layer.

17. The signal transmission line of claim 16, wherein some of the plurality of gaps exist radially in the electrically thin resistive layer.

18. An apparatus, comprising:

an electrically thin resistive layer;

an outer conductor disposed around the electrically thin resistive layer; and a dielectric layer disposed between the electrically thin resistive layer and the outer conductor, wherein a gap exists in the electrically thin resistive layer, and no inner conductor exists in the apparatus.

19. The apparatus of claim 18, wherein the electrically thin resistive layer is substantially transparent to a substantially transverse-electromagnetic (TEM) mode of transmission while substantially completely attenuating higher order modes of transmission.

20. The apparatus of claim 18, wherein the gap exists perimetrically in the electrically thin resistive layer.

21. The apparatus of claim 18, wherein the gap exists radially in the electrically thin resistive layer.

* * * * *